US011646504B2

(12) United States Patent
Park et al.

(10) Patent No.: US 11,646,504 B2
(45) **Date of Patent: *May 9, 2023**

(54) CHIP ANTENNA MODULE ARRAY

(71) Applicant: SAMSUNG ELECTRO-MECHANICS CO., LTD., Suwon-si (KR)

(72) Inventors: Ju Hyoung Park, Suwon-si (KR); Young Sik Hur, Suwon-si (KR); Sung Yong An, Suwon-si (KR); Myeong Woo Han, Suwon-si (KR); Kyu Bum Han, Suwon-si (KR); Dae Ki Lim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/715,425

(22) Filed: Apr. 7, 2022

(65) Prior Publication Data

US 2022/0231431 A1 Jul. 21, 2022

Related U.S. Application Data

(63) Continuation of application No. 16/822,867, filed on Mar. 18, 2020, now Pat. No. 11,322,857.

(30) Foreign Application Priority Data

Nov. 20, 2019 (KR) ..... 10-2019-0149272

(51) Int. Cl.
*H01Q 1/22* (2006.01)
*H01Q 21/06* (2006.01)

(52) U.S. Cl.
CPC ..... *H01Q 21/065* (2013.01); *H01Q 1/2283* (2013.01)

(58) Field of Classification Search
CPC ..... H01Q 1/22; H01Q 1/2283; H01Q 1/243; H01Q 1/36; H01Q 1/38; H01Q 1/48;
(Continued)

(56) References Cited

U.S. PATENT DOCUMENTS 6,556,169 B1 * 4/2003 Fukuura ..... H01Q 1/38 343/700 MS
2012/0235880 A1 9/2012 Kim et al.
(Continued)

FOREIGN PATENT DOCUMENTS

KR 10-2012-0104896 A 9/2012
KR 10-1921182 B1 11/2018
KR 10-2019-0123195 A 10/2019

OTHER PUBLICATIONS

Korean Office Action dated Oct. 14, 2020 in counterpart Korean Patent Application No. 10-2019-0149272. (6 pages in English, 5 pages in Korean).

*Primary Examiner* — Thai Pham
(74) *Attorney, Agent, or Firm* — NSIP Law

(57) ABSTRACT

A chip antenna module array includes a first chip antenna module including: a first solder layer disposed below a first dielectric layer; a first feed via disposed in the first dielectric layer; a first patch antenna pattern disposed above the first dielectric layer and having a first resonant frequency; and a first coupling pattern spaced apart from the first patch antenna pattern, and not vertically overlapping the first patch antenna pattern. The chip antenna module array includes a second chip antenna module including: a second solder layer disposed below a second dielectric layer; a second feed via disposed in the second dielectric layer; a second patch antenna pattern disposed above the second dielectric layer and having a second resonant frequency; and a second coupling pattern disposed above and vertically overlapping the second patch antenna pattern. The first and second chip
(Continued)

antenna modules are disposed spaced apart on a connection member.

15 Claims, 17 Drawing Sheets

(58) Field of Classification Search
CPC ..... H01Q 5/385; H01Q 21/06; H01Q 21/065; H01Q 21/28; H01Q 9/04; H01Q 9/0414; H01Q 9/045
See application file for complete search history.

(56) References Cited

U.S. PATENT DOCUMENTS

| | | | | |
|---|---|---|---|---|
| 2019/0036231 | A1 | 1/2019 | Ryu et al. | |
| 2019/0081414 | A1* | 3/2019 | Kao | H01Q 5/15 |
| 2019/0326672 | A1 | 10/2019 | Lim et al. | |
| 2020/0303805 | A1* | 9/2020 | Ryoo | H01Q 21/28 |
| 2021/0151853 | A1* | 5/2021 | Park | H01Q 1/243 |

* cited by examiner

CHIP ANTENNA MODULE ARRAY

CROSS-REFERENCE TO RELATED APPLICATIONS

This application is a continuation of application Ser. No. 16/822,867 filed on Mar. 18, 2020, which claims the benefit under 35 USC § 119(a) of Korean Patent Application No. 10-2019-0149272 filed on Nov. 20, 2019 in the Korean Intellectual Property Office, the entire disclosure of which is incorporated herein by reference for all purposes.

BACKGROUND

1. Field

The following description relates to a chip antenna module array.

2. Description of Related Art

Mobile communications data traffic is increasing rapidly every year. Technology is being developed to support such increasing data traffic in real time in wireless networks. For example, the content of Internet-based data (IoT)-based data, Augmented Reality (AR), Virtual Reality (VR), Live VR/AR combined with SNS, Autonomous driving, Sync View, Micro-camera Applications such as real-time video transmission require communication (e.g., 5G communications, mmWave communications, etc.) to support the exchange of large amounts of data.

Therefore, recently, millimeter wave (mmWave) communications including 5G (5G) communications have been researched, and studies into the commercialization/standardization of chip antenna modules that smoothly implement mmWave communications are also being conducted.

RF signals in high frequency bands (e.g., 24 GHz, 28 GHz, 36 GHz, 39 GHz, 60 GHz, etc.) are easily absorbed and lost in the manner in which they are delivered, so that the quality of communications can drop dramatically. Therefore, an antenna for high frequency communications may demand a technical approach that is different than the technical approach of a conventional antenna, and it may be necessary to separate the antenna gain (Gain), the integration of the antenna and the RFIC, and the effective isotropic radiated power (EIRP). Development of special technologies, such as power amplifiers, may be needed.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

In one general aspect, a chip antenna module array includes a first chip antenna module including: a first dielectric layer; a first solder layer disposed on a lower surface of the first dielectric layer; a first feed via forming a first feed path through the first dielectric layer; a first patch antenna pattern disposed on an upper surface of the first dielectric layer, configured to be fed from the first feed via, and having a first resonant frequency; and a first coupling pattern spaced apart from the first patch antenna pattern, and configured to not overlap the first patch antenna pattern in a vertical direction. The chip antenna module array includes a second chip antenna module including: a second dielectric layer; a second solder layer disposed on a lower surface of the second dielectric layer; a second feed via forming a second feed path through the second dielectric layer; a second patch antenna pattern disposed on an upper surface of the second dielectric layer, configured to be fed from the second feed via, and having a second resonant frequency different from the first resonant frequency; and a second coupling pattern disposed at a level in a vertical direction higher than the second patch antenna pattern, spaced apart from the second patch antenna pattern, and overlapping the second patch antenna pattern in the vertical direction. The chip antenna module array includes a connection member electrically connected to the first chip antenna module and the second chip antenna module, respectively, and having a top surface on which the first chip antenna module and the second chip antenna module are spaced apart from each other.

The second coupling pattern may include a slot.

The first coupling pattern may have a polygonal shape and may not include a slot.

The first chip antenna module may further include a third coupling pattern disposed at a level in the vertical direction higher than the first patch antenna pattern, spaced apart from the first patch antenna pattern, and overlapping the first patch antenna pattern in the vertical direction. The third coupling pattern may have a polygonal shape and may not include a slot.

The second chip antenna module may further include a fourth coupling pattern spaced apart from the second patch antenna pattern, overlapping the second patch antenna pattern in the vertical direction, and disposed between the second patch antenna pattern and the second coupling pattern. The fourth coupling pattern may have a polygonal shape and may not include a slot.

The second chip antenna module may further include a space filled with an insulating material or air. The space may not overlap the second patch antenna pattern in the vertical direction, and may overlap the second dielectric layer in the vertical direction.

A size of the upper surface of the second dielectric layer may be smaller than a size of the upper surface of the first dielectric layer.

The first chip antenna module may further include: a first feed pattern extending from an upper end of the first feed via and overlapping at least a portion of the first coupling pattern, below the first coupling pattern; and a second feed pattern extending from a lower end of the first feed via and overlapping at least a portion of the first coupling pattern, below the first coupling pattern.

The first coupling pattern may surround at least a portion of an edge of the first patch antenna pattern.

The first coupling pattern and the first patch antenna pattern may be disposed at a same level in the vertical direction.

The upper surface of the first dielectric layer may have a polygonal shape. The first patch antenna pattern may have a polygonal shape, and at least some sides of the first patch antenna pattern may be oblique with respect to each side, among sides, of the upper surface of the first dielectric layer.

The upper surface of the second dielectric layer may have a polygonal shape. The second patch antenna pattern may have a polygonal shape, and at least some sides of the second patch antenna pattern may be oblique with respect to each side, among sides, of the upper surface of the second dielectric layer.

The chip antenna module may further include: a plurality of first chip antenna modules including the first chip antenna module; and a plurality of second chip antenna modules including the second chip antenna module. At least a portion of the plurality of first chip antenna modules and at least a portion of the plurality of second chip antenna modules may overlap in a first horizontal direction. The plurality of second chip antenna modules may be offset from the plurality of first chip antenna modules in a second horizontal direction different from the first horizontal direction.

A dielectric constant of the first dielectric layer and a dielectric constant of the second dielectric layer may be different from each other.

The second feed via may be in contact with the second patch antenna pattern. The first feed via may not be in contact with the first patch antenna pattern.

In another general aspect, a chip antenna module array includes a plurality of first chip antenna modules each including: a first dielectric layer; a first solder layer disposed on a lower surface of the first dielectric layer; a first feed via forming a first feed path through the first dielectric layer; and a first patch antenna pattern disposed on a upper surface of the first dielectric layer, configured to be fed from the first feed via, and having a first resonant frequency. The chip antenna module array includes a plurality of second chip antenna module each including: a second dielectric layer a second solder layer disposed on a lower surface of the second dielectric layer; a second feed via forming a second feed path through the second dielectric layer; and a second patch antenna pattern disposed on a upper surface of the second dielectric layer, configured to be fed from the second feed via, and having a second resonant frequency different from the first resonant frequency. The chip antenna module array includes a connection member having a top surface on which the plurality of first chip antenna modules and the plurality of second chip antenna modules are spaced apart from each other and disposed in an alternating order, and electrically connected to the plurality of first chip antenna modules and the plurality of second chip antenna modules, respectively. The second feed via is in contact with the second patch antenna pattern. The first feed via is not in contact with the first patch antenna pattern.

Each of the plurality of second chip antenna modules may further include a second coupling pattern spaced apart from the second patch antenna pattern, above the second patch antenna pattern, and overlapping the second patch antenna pattern in a vertical direction. Each of the plurality of first chip antenna modules may further include third coupling patterns spaced apart from the first patch antenna pattern, above the first patch antenna pattern, and overlapping the first patch antenna pattern in a vertical direction. The second coupling pattern may include a slot and may have a ring shape. The third coupling pattern may have a polygonal shape and may not include a slot.

A size of the upper surface of the second dielectric layer may be smaller than a size of the upper surface of the first dielectric layer.

Each of the plurality of first chip antenna modules may further include: a first coupling pattern spaced apart from the first patch antenna pattern and not overlapping the first patch antenna pattern in a vertical direction; a first feed pattern extending from an upper end of the first feed via and overlapping at least a portion of the first coupling pattern, below the first coupling pattern; and a second feed pattern extending from a lower end of the first feed via and overlapping at least a portion of the first coupling pattern, below the first coupling pattern.

At least a portion of the plurality of first chip antenna modules and at least a portion of the plurality of second chip antenna modules may overlap in a first horizontal direction. The plurality of second chip antenna modules may be offset from the plurality of first chip antenna modules in a second horizontal direction different from the first horizontal direction.

A dielectric constant of the first dielectric layer and a dielectric constant of the second dielectric layer may be different from each other.

In another general aspect, a chip antenna module array includes: a connection member; a first chip antenna module; and a second chip antenna module. The first chip antenna module is disposed on the connection member, is in electrical connection with the connection member, and includes: a first solder layer; a first patch antenna pattern disposed above the first solder layer; a first dielectric layer disposed between the first solder layer and the first patch antenna pattern; a first feed via forming a first feed path to the through the first dielectric layer and configured to feed the first patch antenna pattern; a first coupling pattern having a polygonal shape and excluding a slot, wherein the first coupling pattern is laterally spaced apart from the first patch antenna pattern and does not overlap the a first patch antenna pattern in a space above the first patch antenna pattern. The second chip antenna module is disposed spaced apart from the first chip antenna module on the connection member, is in electrical connection with the connection member, and includes: a second solder layer; a second patch antenna pattern disposed above the second solder layer; a second dielectric layer disposed between the second solder layer and the second patch antenna pattern; a second feed via forming a second feed path through the second dielectric layer and configured to feed the second patch antenna pattern; and a second coupling pattern having a polygonal shape and including a slot, wherein the second coupling pattern is disposed spaced apart from the second patch antenna pattern, above the second patch antenna pattern, and overlaps the second patch antenna pattern in a space above the second patch antenna pattern.

A size of an upper surface of the second dielectric layer may be smaller than a size of an upper surface of the first dielectric layer.

The first coupling pattern and the first patch antenna pattern may be disposed at a same height.

A frequency band of the first chip antenna module may be lower than a frequency band of the second chip antenna module.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
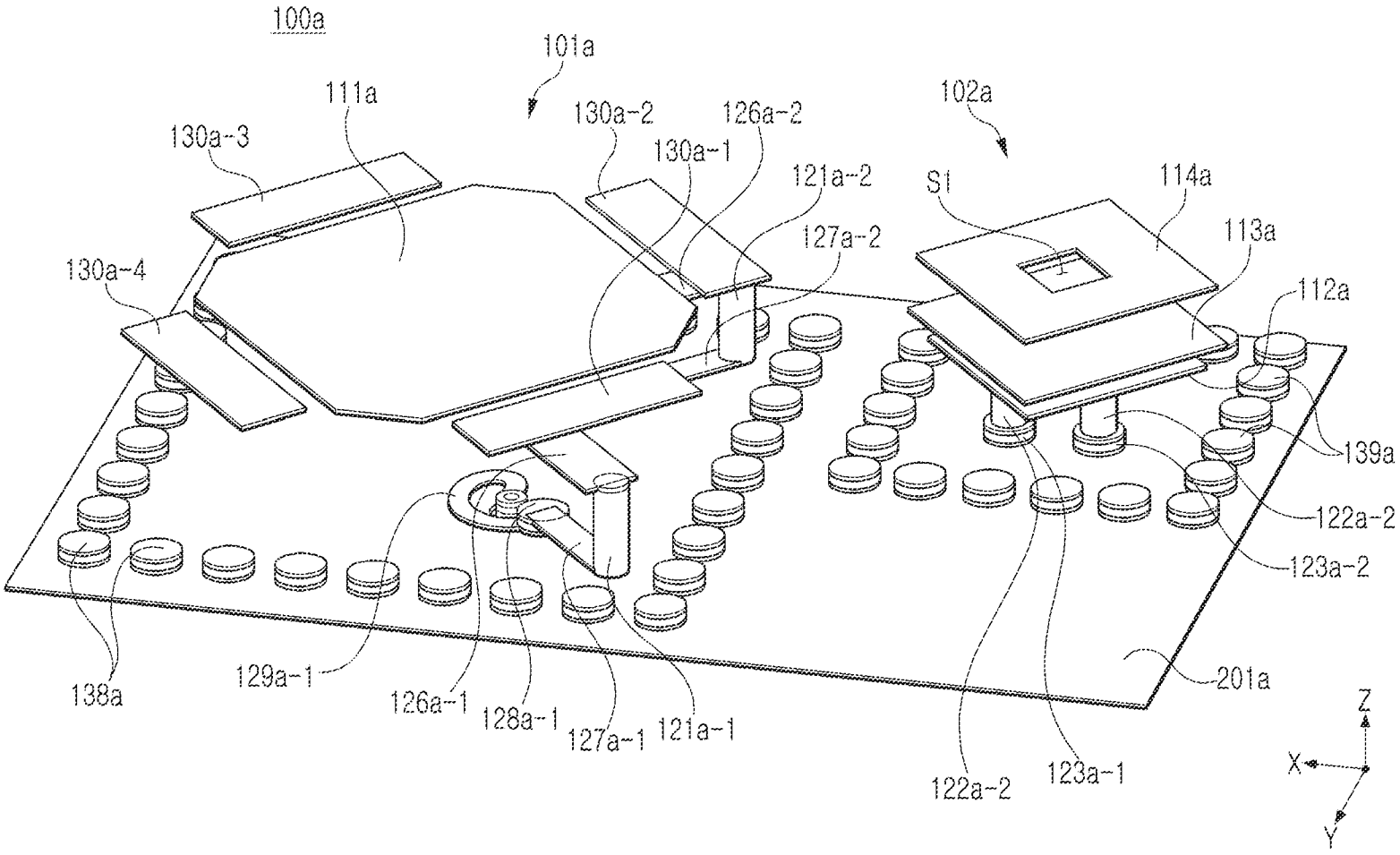
FIGS. 1A and 1B are perspective views illustrating first and second chip antenna modules included in a chip antenna module array, according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Figure 1B:
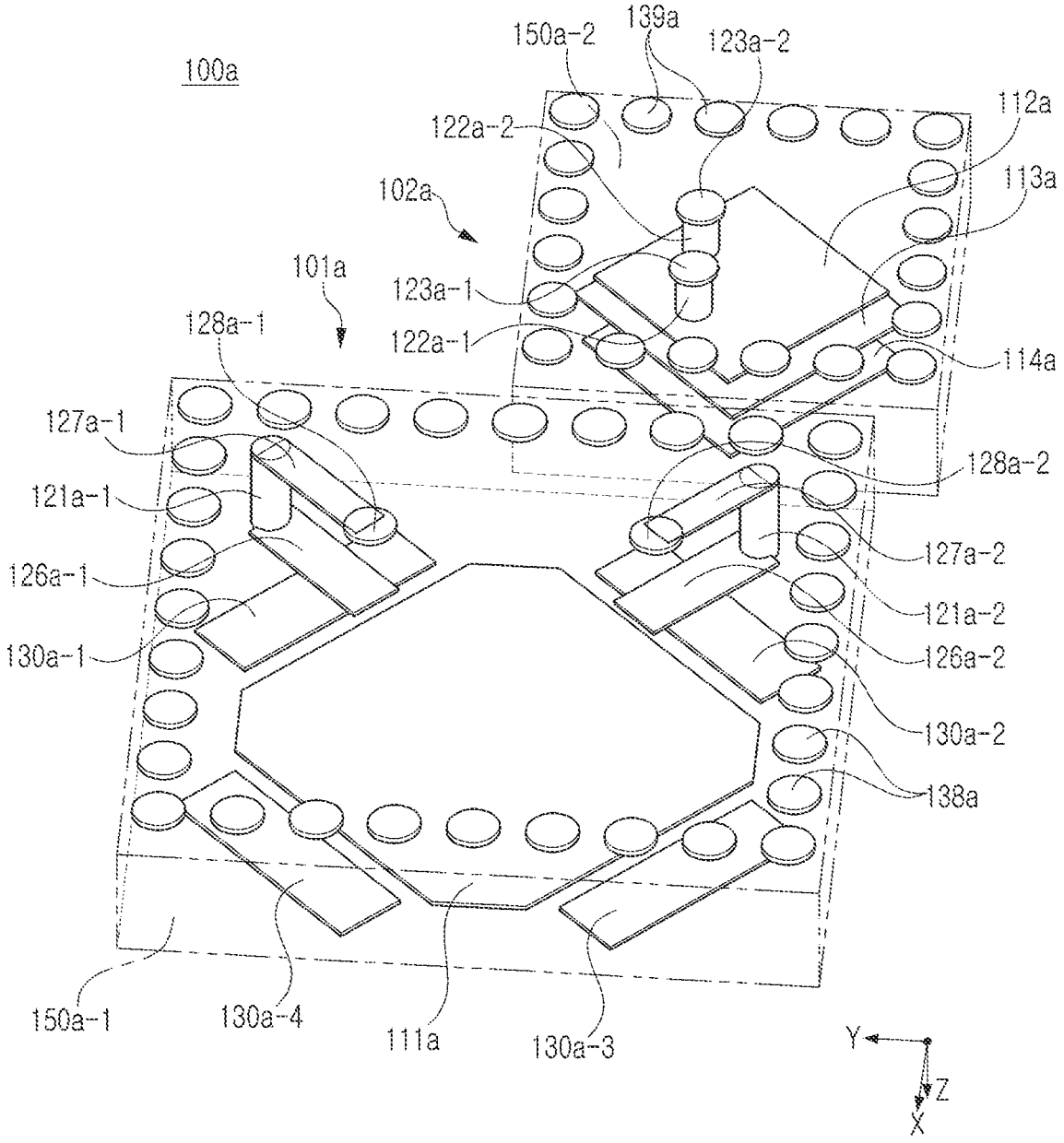
Figure 1C:
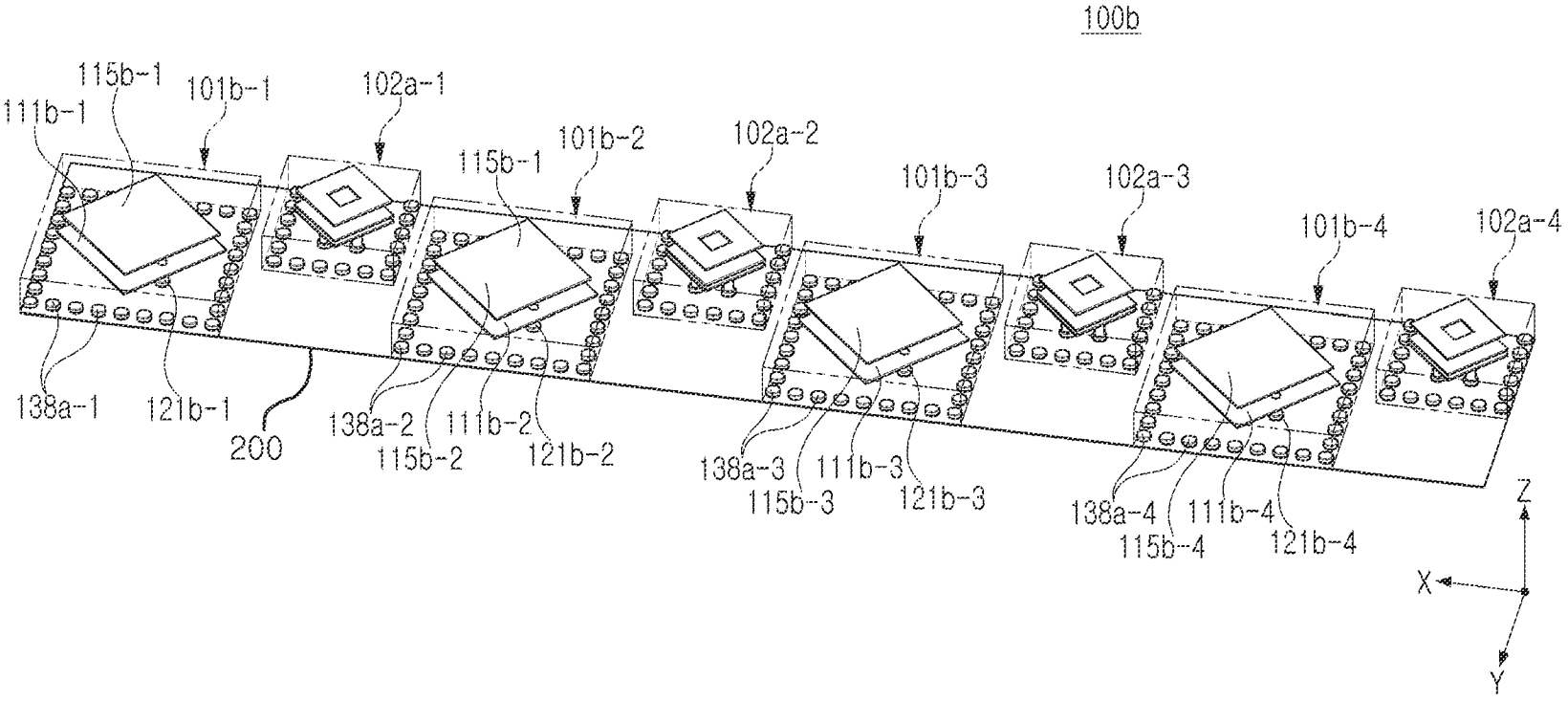
FIG. 1C is a perspective view of the chip antenna module array of FIGS. 1A and 1B, according to an example.

FIGS. 1A and 1B are perspective views illustrating first and second chip antenna modules included in a chip antenna module array, according to an example.

Referring to FIGS. 1A and 1B, a chip antenna module array 100*a*, according to an example, may include a first chip antenna module 101*a*, a second chip antenna module 102*a*, and a connection member including a ground plane 201*a*.

The connection member may have a top surface on which a plurality of the first chip antenna modules 101*a* and a plurality of second chip antenna modules 102*a* are arranged in an alternating order while being spaced apart from each other, and the connection member may be respectively electrically connected to the plurality of first chip antenna modules 101*a* and the plurality of second chip antenna modules 102*a*. For example, the connection member may have a stacked structure in which a plurality of ground planes and a plurality of insulating layers are alternately stacked, and may be electrically connected between the plurality of first and second chip antenna modules 101*a* and 102*a* and an integrated circuit (IC).

The first chip antenna module 101*a* may include a first dielectric layer 150*a*-1, a first solder layer 138*a*, first feed vias 121*a*-1 and 121*a*-2, a first patch antenna pattern 111*a*, and coupling patterns 130*a*-1, 130*a*-2, 130*a*-3 and 130*a*-4.

The second chip antenna module 102*a* may include a second dielectric layer 150*a*-2, a second solder layer 139*a*, second feed vias 122*a*-1 and 122*a*-2, a second patch antenna pattern 112*a*, and a second coupling pattern 114*a*.

Upper surfaces of the first and second dielectric layers 150*a*-1 and 150*a*-2 may be used as arrangement spaces of the first and second patch antenna patterns 111*a* and 112*a*, respectively, and lower surfaces of the first and second dielectric layers 150*a*-1 and 150*a*-2 may be used as arrangement spaces of the first and second solder layers 138*a* and 139*a*, respectively. That is, the first and second patch antenna patterns 111*a* and 112*a* may be disposed on the upper surfaces of the first and second dielectric layers 150*a*-1 and 150*a*-2, respectively, and first and second solder layers 138*a* and 139*a* may be disposed on the lower surfaces of the first and second dielectric layers 150*a*-1 and 150*a*-2, respectively.

The first and second dielectric layers 150*a*-1 and 150*a*-2 may function as passage paths for radio frequency (RF) signals radiated through lower surfaces of the first and second patch antenna patterns 111*a* and 112*a*. The RF signal may have a wavelength in the first and second dielectric layers 150*a*-1 and 150*a*-2 corresponding to the dielectric constants of the first and second dielectric layers 150*a*-1 and 150*a*-2, respectively.

A separation distance between the first and second patch antenna patterns 111*a* and 112*a* and the first and second solder layers 138*a* and 139*a* may be optimized based on the wavelength of the RF signal, and the shorter the wavelength is, the more easily the separation distance may be shortened. Therefore, the thickness of the first and second dielectric layers 150*a*-1 and 150*a*-2 in a vertical direction, for example, in the Z direction, may be more easily reduced as the dielectric constants of the first and second dielectric layers 150*a*-1 and 150*a*-2 are further increased.

The horizontal (for example, X and/or Y direction) size of each of the first and second patch antenna patterns 111*a* and 112*a* and the first and second solder layers 138*a* and 139*a* may be optimized, based on the wavelength of the RF signal. The shorter the wavelength of the RF signal is, the more easily the horizontal size of each of the first and second patch antenna patterns 111*a* and 112*a* and the first and second solder layers 138*a* and 139*a* may be reduced. Accordingly, the horizontal (for example, X and/or Y direction) sizes of the first and second dielectric layers 150*a*-1 and 150*a*-2 may be more easily reduced as dielectric constants of the first and second dielectric layers 150*a*-1 and 150*a*-2 are increased.

Therefore, the overall size of the first and second chip antenna modules 101*a* and 102*a* may be more easily reduced as the dielectric constants of the first and second dielectric layers 150*a*-1 and 150*a*-2 are increased.

In general, patch antennas may be implemented as a portion of a substrate, such as a printed circuit board (PCB), but miniaturization of patch antennas may be limited by the relatively low dielectric constant of the general insulating layer of a printed circuit board (PCB).

Since the first and second chip antenna modules 101*a* and 102*a* may be manufactured separately from a substrate such as a printed circuit board (PCB), it may be easier to implement the first and second dielectric layers 150*a*-1 and 150*a*-2 to have a higher dielectric constant than a dielectric constant of a general insulating layer of the printed circuit board (PCB).

For example, the first and second dielectric layers 150*a*-1 and 150*a*-2 may include a ceramic material configured to have a dielectric constant higher than a dielectric constant of a general insulating layer of a printed circuit board (PCB).

For example, the first and second dielectric layers 150*a*-1 and 150*a*-2 may be formed of a material having a relatively high dielectric constant, for example, a ceramic-based material such as a low temperature co-fired ceramic (LTCC) or a glass-based material. The first and second dielectric layers 150*a*-1 and 150*a*-2 may further include any one or any combination of any two or more of magnesium (Mg), silicon (Si), aluminum (Al), calcium (Ca), and titanium (Ti), thereby providing a relatively high dielectric constant or high durability. For example, the first and second dielectric layers 150*a*-1 and 150*a*-2 may include any one or any combination of any two or more of $Mg_2SiO_4$, $MgAlO_4$, and $CaTiO_3$.

For example, the first and second dielectric layers 150*a*-1 and 150*a*-2 may have a structure in which a plurality of dielectric layers are stacked. The spaces between the dielectric layers may be arrangement spaces of the first feed patterns 126*a*-1 and 126*a*-2 and/or the second feed patterns 127*a*-1 and 127*a*-2. In the spaces between the plurality of dielectric layers, portions in which the first feed patterns 126*a*-1 and 126*a*-2 and/or the second feed patterns 127*a*-1 and 127*a*-2 are not disposed may be filled with an adhesive material (for example, a polymer).

The first and second solder layers 138*a* and 139*a* may be configured to support mounting of the first and second chip antenna modules 101*a* and 102*a* on the connection member. For example, the first and second solder layers 138*a* and 139*a* may be disposed along the edges of the first and second dielectric layers 150*a*-1 and 150*a*-2. For example, the first and second solder layers 138*a* and 139*a* may be configured to facilitate bonding to tin-based solders having a relatively low melting point, and, thus, may include a tin plating layer and/or a nickel plating layer, to facilitate coupling to the solders.

In addition, the first and second solder layers 138*a* and 139*a* may each have a structure in which a plurality of cylinders are arranged, to efficiently support mounting of the first and second chip antenna modules 101*a* and 102*a* on the connection member.

The first feed vias 121*a*-1 and 121*a*-2 and the second feed vias 122*a*-1 and 122*a*-2 may form first and second feed paths, respectively, through the first and second dielectric layers 150*a*-1 and 150*a*-2, respectively.

For example, the first feed vias 121*a*-1 and 121*a*-2 and the second feed vias 122*a*-1 and 122*a*-2 may have a structure extending in the vertical direction in the first and second dielectric layers 150*a*-1 and 150*a*-2, respectively, and may be formed by a process of filling through-holes formed by the laser in the first and second dielectric layers 150*a*-1 and 150*a*-2 with a conductive material such as copper, nickel, tin, silver, gold, palladium, or the like.

The first patch antenna patterns 111*a* may be fed from the first feed vias 121*a*-1 and 121*a*-2, and the second patch antenna patterns 112*a* may be fed from the second feed vias 122*a*-1 and 122*a*-2. The first and second patch antenna patterns 111*a* and 112*a* may be configured to transmit and/or receive an RF signal.

For example, the first and second patch antenna patterns 111*a* and 112*a* may be formed as a conductive paste is dried in a state in which the conductive paste is applied and/or filled on the first and second dielectric layers 150*a*-1 and 150*a*-2, respectively.

The wavelength of the RF signal emitted from the first and second patch antenna patterns 111*a* and 112*a* may correspond to the horizontal direction (for example, the X direction and/or the Y direction) size of the first and second patch antenna patterns 111*a* and 112*a*. Accordingly, the first and second patch antenna patterns 111*a* and 112*a* may be configured to form a radiation pattern in the vertical direction (for example, the Z direction) while generating resonance.

When the first chip antenna module 101*a* is configured to have a first resonant frequency (for example, 28 GHz), the first patch antenna pattern 111*a* may have a size corresponding to the wavelength of the first resonant frequency. When the second chip antenna module 102*a* is configured to have a second resonant frequency (for example, 39 GHz) different from the first resonant frequency, the second patch antenna pattern 112*a* may have a size corresponding to the wavelength of the second resonant frequency.

According to an example, when the first chip antenna module 101*a* is configured to have the first resonant frequency, the upper surface of the first dielectric layer 150*a*-1 may have a size corresponding to the wavelength of the first resonant frequency, and when the second chip antenna module 102*a* is configured to have a second resonant frequency, the upper surface of the second dielectric layer 150*a*-2 may have a size corresponding to the wavelength of the second resonant frequency.

For example, when the second resonant frequency is higher than the first resonant frequency, the size of the second patch antenna pattern 112*a* may be smaller than the size of the first patch antenna pattern 111*a*, and the size of the upper surface of the second dielectric layer 150*a*-2 may be smaller than the size of the upper surface of the first dielectric layer 150*a*-1.

In the case in which the plurality of first chip antenna modules 101*a* and the plurality of second chip antenna modules 102*a* are arranged in an alternating order to be spaced apart from each other, the plurality of second chip antenna modules 102*a* may affect the electromagnetic boundary conditions of the plurality of first chip antenna modules 101*a*, and the plurality of first chip antenna modules 101*a* may affect the electromagnetic boundary conditions of the plurality of second chip antenna modules 102*a*.

For example, in the case which the plurality of first chip antenna modules 101*a* and the plurality of second chip antenna modules 102*a* are arranged in an alternating order to be spaced apart from each other, separation distances between the plurality of first and second chip antenna modules 101*a* and 102*a* may be similar to each other, and may act as an element affecting the resonant frequencies of the plurality of respective first and second chip antenna modules 101*a* and 102*a*. In such an example additionally having the first resonant frequency that is lower than the second resonant frequency, the resonant frequency based on the separation distance may be higher than the first resonant frequency, and may be lower than the second resonant frequency. Accordingly, there is an antenna design element that the antenna characteristics (for example, gain and bandwidth) of the plurality of first chip antenna modules 101*a* and the antenna characteristics of the plurality of second chip antenna modules 102*a* are to be harmonized with each other.

Accordingly, the chip antenna module array 100*a*, according to an example, may be configured such that an electromagnetic coupling structure of the first patch antenna pattern 111*a* of the first chip antenna module 101*a*, and an electromagnetic coupling structure of the second patch antenna pattern 112*a* of the second chip antenna module 102*a* are different from each other.

As a result, the influence of the separation distance of the plurality of first and second chip antenna modules 101*a* and 102*a* on the antenna characteristics of the plurality of first and second chip antenna modules 101*a* and 102*a* may be reduced. Therefore, the overall antenna performance of the first and second chip antenna modules 101*a* and 102*a* may be improved, and the plurality of first and second chip antenna modules 101*a* and 102*a* may be arranged more compactly.

For example, in comparison to a conventional chip antenna module array, the size of the chip antenna module array 100*a* for a given number of chip antenna modules in the chip antenna module array 100*a* may be reduced, and the antenna performance may be improved compared with the size of the chip antenna module array 100*a*.

The first coupling patterns 130*a*-1, 130*a*-2, 130*a*-3 and 130*a*-4 may be spaced apart from the first patch antenna pattern 111*a* in a horizontal direction (for example, in the X direction and/or the Y direction), and may not overlap the first patch antenna pattern 111*a* in the vertical direction (for example, the Z direction).

The second coupling pattern 114*a* may be disposed above (for example, in the Z direction) the second patch antenna pattern 112*a* so as to be spaced apart from the second patch antenna pattern 112*a* in the vertical direction (for example, the Z direction), and may overlap the second patch antenna pattern 112*a* in the vertical direction (for example, the Z direction).

Accordingly, the electromagnetic coupling direction of the first patch antenna pattern 111*a* may be close to the horizontal direction (for example, the X direction and/or the Y direction), and the electromagnetic coupling direction of the second patch antenna pattern 112*a* may be closed to the vertical direction (for example, the Z direction). Thus, the electromagnetic coupling directions of the first and second patch antenna patterns 111*a* and 112*a* may be different from each other.

Electromagnetic coupling directions of the first and second patch antenna patterns 111*a* and 112*a* may affect radiation pattern characteristics of the first and second chip antenna modules 101*a* and 102*a*.

The plurality of first and second chip antenna modules 101*a* and 102*a* may be configured such that the effect of a difference in electromagnetic coupling directions between the first and second patch antenna patterns 111*a* and 112*a* may be cancelled by the effect of a resonance frequency difference and an electromagnetic boundary condition element of the plurality of first and second chip antenna modules 101*a* and 102*a*.

Accordingly, the overall antenna performance of the plurality of first and second chip antenna modules 101*a* and 102*a* may be improved, and the plurality of first and second chip antenna modules 101*a* and 102*a* may be arranged more compactly.

Referring to FIGS. 1A and 1B, the second coupling pattern 114*a* may include a slot S1 and have a ring shape. Accordingly, since the surface current flowing through the second coupling pattern 114*a* may flow in the direction of rotation around the slot, the size of the second coupling pattern 114*a* depending on the optimization of the RF signal wavelength may be further reduced.

The first coupling patterns 130*a*-1, 130*a*-2, 130*a*-3 and 130*a*-4 may have a polygonal shape that does not include a slot.

Accordingly, the difference in electromagnetic coupling characteristics of the first and second patch antenna patterns 111*a* and 112*a* may be further increased, so that the antenna performance of the plurality of first and second chip antenna modules 101*a* and 102*a* is more freely designed. Further, the overall antenna performance of the chip antenna module array 100*a* may be further improved.

Referring to FIGS. 1A and 1B, the second chip antenna module 102*a* of the chip antenna module array 100*a*, according to an example, may further include a fourth coupling pattern 113*a* disposed between the second patch antenna pattern 112*a* and the second coupling pattern 114*a* so as to be spaced apart from the second patch antenna pattern 112*a*, and overlapping the second patch antenna pattern 112*a* in the vertical direction (for example, the Z direction).

Accordingly, the second chip antenna module 102*a* may obtain a relatively wider bandwidth without increasing the size of the second chip antenna module 102*a* in the horizontal direction.

The fourth coupling pattern 113*a* may have a polygonal shape that does not include a slot.

Accordingly, the difference between the impedance provided by the fourth coupling pattern 113*a* and the impedance provided by the second coupling pattern 114*a* may be further increased without increasing the horizontal size of the second chip antenna module 102*a*. Thus, the second patch antenna pattern 112*a* may receive more various impedances and may have a relatively wider bandwidth.

Referring to FIGS. 1A and 1B, the second chip antenna module 102*a* may be configured to have a space overlapping a corresponding second dielectric layer 150-2 in the vertical direction and not overlapping a corresponding second patch antenna pattern 112*a* in the vertical direction, is filled with an insulating material or air.

Accordingly, since the electromagnetic coupling of the second patch antenna pattern 112*a* may be further concentrated in the vertical direction, the difference between the electromagnetic coupling characteristics of the first and second patch antenna patterns 111*a* and 112*a* may be further increased. Therefore, the antenna performance of the plurality of first and second chip antenna modules 101*a* and 102*a* may be designed more freely, and the overall antenna performance of the chip antenna module array 100*a* may be further improved.

Referring to FIGS. 1A and 1B, the first chip antenna module 101*a* may further include at least one of first feed patterns 126*a*-1 and 126*a*-2, second feed patterns 127*a*-1 and 127*a*-2, a feed connection structure 128*a*-1 and a detour pattern 129*a*-1.

The first feed patterns 126*a*-1 and 126*a*-2 are disposed to be lower (for example, in the Z direction) than the first coupling patterns 130*a*-1, 130*a*-2, 130*a*-3 and 130*a*-4 and may extend, in an XY plane, from upper ends of the first feed vias 121*a*-1 and 121*a*-2 to overlap at least portions of the first coupling patterns 130*a*-1, 130*a*-2, 130*a*-3 and 130*a*-4 in the vertical direction (for example, the Z direction).

Since the first feed patterns 126*a*-1 and 126*a*-2 overlap the first coupling patterns 130*a*-1, 130*a*-2, 130*a*-3 and 130*a*-4 in the vertical direction (for example, the Z direction), the first feed patterns 126*a*-1 and 126*a*-2 and the first coupling patterns 130*a*-1, 130*a*-2, 130*a*-3 and 130*a*-4 may form a first capacitance. Since the first coupling patterns 130*a*-1, 130*a*-2, 130*a*-3 and 130*a*-4 are electromagnetically coupled to the first patch antenna pattern 111*a*, the first capacitance may be transferred to the first patch antenna pattern 111*a*.

Therefore, the bandwidth of the first patch antenna pattern 111*a* may be further widened.

For example, the first coupling patterns 130*a*-1, 130*a*-2, 130*a*-3 and 130*a*-4 may have a form extending in a first direction (for example, in an XY plane), and the first feed patterns 126*a*-1 and 126*a*-2 may have a shape extending from the upper ends of the first feed vias 121*a*-1 and 121*a*-2 in a second direction (for example in an XY plane) different from the first direction. For example, the first direction and the second direction may be perpendicular to each other.

Accordingly, the first capacitance may be easily adjusted by at least one of the second direction length, width, and a separation distance of the first feed patterns 126*a*-1 and 126*a*-2, and a bandwidth of the first patch antenna pattern 111*a* may be widened more efficiently.

The second feed patterns 127*a*-1 and 127*a*-2 may provide an inductance that may affect the resonant frequency of the first patch antenna pattern 111*a* to the first patch antenna pattern 111*a*. The inductance may be adjusted by adjusting the lengths of the second feed patterns 127*a*-1 and 127*a*-2.

For example, the second feed patterns 127*a*-1 and 127*a*-2 are disposed to be lower (for example, in the Z direction) than the first coupling patterns 130*a*-1, 130*a*-2, 130*a*-3 and 130*a*-4, and may extend in an XY plane from lower ends of the first feed vias 121*a*-1 and 121*a*-2 to overlap at least portions of the first coupling patterns 130*a*-1, 130*a*-2, 130*a*-3 and 130*a*-4.

When the second feed patterns 127*a*-1 and 127*a*-2 overlap the first coupling patterns 130*a*-1, 130*a*-2, 130*a*-3 and 130*a*-4 in the vertical direction (for example, the Z direction), the first feed patterns 126*a*-1 and 126*a*-2 and the first coupling patterns 130*a*-1, 130*a*-2, 130*a*-3 and 130*a*-4 may form a second capacitance.

The distance between the second feed patterns 127*a*-1 and 127*a*-2 and the first coupling patterns 130*a*-1, 130*a*-2, 130*a*-3 and 130*a*-4 in the vertical direction (for example, the Z direction) may be greater than the distance between the first feed patterns 126*a*-1 and 126*a*-2 and the first coupling patterns 130*a*-1, 130*a*-2, 130*a*-3 and 130*a*-4 in the vertical direction (for example, the Z direction). Thus, the second capacitance may be smaller than the first capacitance.

Since the first chip antenna module 101*a* may relatively easily increase the dielectric constant of the first dielectric layer 150*a*-1, the second capacitance may be greater than the capacitance based on a general insulating layer of a substrate such as a printed circuit board (PCB).

Therefore, the first chip antenna module 100*a* may not only use the first capacitance, but may also use the second capacitance.

A lowest frequency of a bandwidth of the first patch antenna pattern 111*a* may be efficiently implemented based on a relatively low resonant frequency based on the first capacitance, and a highest frequency of the bandwidth may be efficiently implemented based on a relatively high resonant frequency based on the second capacitance.

The second feed patterns 127*a*-1 and 127*a*-2 may have a form extending from the lower ends of the first feed vias 121*a*-1 and 121*a*-2 in the second direction. For example, the second feed patterns 127*a*-1 and 127*a*-2, the first feed vias 121*a*-1 and 121*a*-2, and the first feed patterns 126*a*-1 and 126*a*-2 may form a U shape. Accordingly, since the second capacitance may be easily adjusted by adjusting a length of the second feed patterns 127*a*-1 and 127*a*-2 in the second direction, the bandwidth of the first patch antenna pattern 111*a* may be more efficiently widened.

The first coupling patterns 130*a*-1, 130*a*-2, 130*a*-3 and 130*a*-4 may be arranged to surround at least a portion of an edge of the first patch antenna pattern 111*a*. The first coupling patterns 130*a*-1, 130*a*-2, 130*a*-3 and 130*a*-4 and the first patch antenna pattern 111*a* may be at the same level in the Z direction.

Accordingly, since the electromagnetic coupling direction of the first patch antenna pattern 111*a* may be more concentrated in the horizontal direction, the difference in electromagnetic coupling characteristics of the first and second patch antenna patterns 111*a* and 112*a* may be further increased. Therefore, the antenna performance of the plurality of first and second chip antenna modules 101*a* and 102*a* may be designed more freely, and the overall antenna performance of the chip antenna module array 100*a* may be further improved.

The feed connection structure 128*a*-1 may be connected between the second feed patterns 127*a*-1 and 127*a*-2 and the detour pattern 129*a*-1.

The detour pattern 129*a*-1 may be disposed at the same level in the Z direction as the second feed patterns 127*a*-1 and 127*a*-2 or at a level lower in the Z direction than the second feed patterns 127*a*-1 and 127*a*-2, and may be electrically connected to the second feed patterns 127*a*-1 and 127*a*-2. The detour pattern 129*a*-1 may have a curved form extending in a path around one point.

The detour pattern 129*a*-1 may provide an inductance used for impedance matching of the second feed patterns 127*a*-1 and 127*a*-2, and may provide a relatively great inductance as it has a shape that is curved around one point.

Referring to FIGS. 1A and 1B, the second feed vias 122*a*-1 and 122*a*-2 may be disposed to be in contact with the second patch antenna pattern 112*a*, and the first feed vias 121*a*-1 and 121*a*-2 may not contact to the first patch antenna pattern 111*a*.

For example, the first patch antenna pattern 111*a* may be fed indirectly by the first feed vias 121*a*-1 and 121*a*-2, the first feed patterns 126*a*-1 and 126*a*-2, the second feed patterns 127*a*-1 and 127*a*-2, and first coupling patterns 130*a*-1, 130*a*-2, 130*a*-3 and 130*a*-4, and the second patch antenna pattern 112*a* may be fed directly by the second feed vias 122*a*-1 and 122*a*-2.

Accordingly, the overall coupling characteristics of the first patch antenna pattern 111*a* and the overall coupling characteristics of the second patch antenna pattern 112*a* may be different from each other.

Overall coupling characteristics of the first and second patch antenna patterns 111*a* and 112*a* may affect radiation pattern characteristics of the first and second chip antenna modules 101*a* and 102*a*.

The plurality of first and second chip antenna modules 101*a* and 102*a* may use the difference in electromagnetic coupling characteristics of the first and second patch antenna patterns 111*a* and 112*a* for canceling the differences in the electromagnetic boundary condition elements of the plurality of first and second chip antenna modules 101*a*, 102*a*.

Accordingly, the overall antenna performance of the plurality of first and second chip antenna modules 101*a* and 102*a* may be improved, and the plurality of first and second chip antenna modules 101*a* and 102*a* may be arranged more compactly.

FIG. 10 is a perspective view of the chip antenna module array according to an example.

Referring to FIG. 10, a chip antenna module array 100*b* may have a structure in which a plurality of first chip antenna modules 101*b*-1, 101*b*-2, 101*b*-3, and 101*b*-4 and a plurality of second chip antenna modules 102*a*-1, 102*a*-2, 102*a*-3, and 102*a*-4 are arranged in an alternating order in the X direction on a connection member 200. The second chip antenna modules 102*a*-1, 102*a*-2, 102*a*-3, and 102*a*-4 may have the same structure as that of the second chip antenna module 102*a* in FIGS. 1A and 1B.

The plurality of first chip antenna modules 101*b*-1, 101*b*-2, 101*b*-3, and 101*b*-4 may include: first patch antenna patterns 111*b*-1, 111*b*-2, 111*b*-3, and 111*b*-4, respectively; first feed vias 121*b*-1, 121*b*-2, 121*b*-3, 121*b*-4, respectively; first solder layers 138*a*-1, 138*a*-2, 138*a*-3, and 138*a*-4, respectively; and a third coupling patterns 115*b*-1, 115*b*-2, 115*b*-3, and 115*b*-4, respectively.

The third coupling patterns 115*b*-1, 115*b*-2, 115*b*-3, and 115*b*-4 may be disposed to overlap with the first patch antenna patterns 111*b*-1, 111*b*-2, 111*b*-3, and 111*b*-4, respectively, in the vertical direction (for example, the Z direction), and may be spaced apart from the first patch antenna patterns 111*b*-1, 111*b*-2, 111*b*-3, and 111*b*-4, respectively, in the vertical direction (for example, the Z direction).

Accordingly, since the third coupling patterns 115*b*-1, 115*b*-2, 115*b*-3, and 115*b*-4 have additional resonant impedances that are respectively provided to the first patch antenna patterns 111*b*-1, 111*b*-2, 111*b*-3, and 111*b*-4, the bandwidth of the first patch antenna patterns 111*b*-1, 111*b*-2, 111*b*-3, and 111*b*-4 may be wider.

In addition, the third coupling patterns 115*b*-1, 115*b*-2, 115*b*-3, and 115*b*-4 may have a polygonal shape that does not include a slot.

Accordingly, since the difference in the electromagnetic coupling characteristics of the plurality of first chip antenna modules 101*b*-1, 101*b*-2, 101*b*-3, and 101*b*-4 and the plurality of second chip antenna modules 102*a*-1, 102*a*-2, 102*a*-3, and 102*a*-4 may be greater, the antenna performance of the plurality of first and second chip antenna modules 101*b*-1, 101*b*-2, 101*b*-3, 101*b*-4, 102*a*-1, 102*a*-2, 102*a*-3 and 102*a*-4 may be more freely designed, and the overall antenna performance of the chip antenna module array 100*b* may be further improved.

Referring to FIG. 10, the top surfaces of the first chip antenna modules 101*b*-1, 101*b*-2, 101*b*-3, and 101*b*-4 may have a polygonal shape, and the first patch antenna patterns 111*b*-1 and 111*b*-2, 111*b*-3, and 111*b*-4 may each have at least some sides that are oblique with respect to each side of the top surface of the respective first chip antenna module 101*b*-1, 101*b*-2, 101*b*-3, or 101*b*-4.

For example, in an example in which upper surfaces of the first chip antenna modules 101*b*-1, 101*b*-2, 101*b*-3, and 101*b*-4 and the first patch antenna patterns 111*b*-1, 111*b*-2, 111*b*-3, and 111*b*-4 have a shape of a quadrangle, respectively, the first patch antenna patterns 111*b*-1, 111*b*-2, 111*b*-3, and 111*b*-4 may be rotated 45 degrees with respect to the top surface of the respective first chip antenna module 101*b*-1, 101*b*-2, 101*b*-3, or 101*b*-4. In an example in which the top surfaces of the plurality of first chip antenna modules 101*b*-1, 101*b*-2, 101*b*-3, and 101*b*-4 have a shape of a square, the first patch antenna patterns 111*b*-1, 111*b*-2, 111*b*-3, and 111*b*-4 may have a shape of a rhombus.

Since surface currents of the first patch antenna patterns 111*b*-1, 111*b*-2, 111*b*-3, and 111*b*-4 may flow from one side to another side of the first patch antenna patterns 111*b*-1, 111*b*-2, 111*b*-3, and 111*b*-4, respectively, the electric field according to the surface currents may be formed in a first horizontal direction. The magnetic field according to the surface current may be formed in a second horizontal direction.

In an example in which at least some sides of the first patch antenna patterns 111*b*-1, 111*b*-2, 111*b*-3, and 111*b*-4 are oblique to each side of the upper surface of the a respective first chip antenna module 101*b*-1, 101*b*-2, 101*b*-

3, or 101*b*-4, horizontal directions of electric field and the magnetic field according to the surface currents of the plurality of first chip antenna modules 101*b*-1, 101*b*-2, 101*b*-3, 101*b*-4 may be rotated in comparison to a configuration in which sides of patch antenna patterns are parallel to corresponding sides of an upper surface of a respective chip antenna module.

In order to reduce the overall size of the chip antenna module array 100*b*, the chip antenna modules 101*b*-1, 101*b*-2, 101*b*-3, 101*b*-4, 102*a*-1, 102*a*-2, 102*a*-3, 102*a*-4 may be disposed such that side surfaces of the first chip antenna modules 101*b*-1, 101*b*-2, 101*b*-3, and 101*b*-4 are parallel to side surfaces of the second chip antenna modules 102*a*-1, 102*a*-2, 102*a*-3, 102*a*-4. In such an example, horizontal directions of the electric field and the magnetic field according to the surface current of the first patch antenna patterns 111*b*-1, 111*b*-2, 111*b*-3, and 111*b*-4 may be different from an arrangement direction of the plurality of first and second chip antenna modules.

Accordingly, the electromagnetic interference between the plurality of first chip antenna modules 101*b*-1, 101*b*-2, 101*b*-3, and 101*b*-4 and the plurality of second chip antenna modules 102*a*-1, 102*a*-2, 102*a*-3, and 102*a*-4 may be reduced, the overall gain of the chip antenna module array 100*b* may be improved, and the overall size of the chip antenna module array 100*b* may be reduced.

Referring to FIG. 10, upper surfaces of the second chip antenna modules 102*a*-1, 102*a*-2, 102*a*-3, and 102*a*-4 may have a polygonal shape. The chip antenna modules 102*a*-1, 102*a*-2, 102*a*-3, and 102*a*-4 may have an oblique polygonal shape with respect to each side of the upper surface of the respective second patch antenna pattern included therein.

Accordingly, the electromagnetic interference between the plurality of second chip antenna modules 102*a*-1, 102*a*-2, 102*a*-3, and 102*a*-4 and the plurality of first chip antenna modules 101*b*-1, 101*b*-2, 101*b*-3, and 101*b*-4 may be reduced, the overall gain of the chip antenna module array 100*b* according to an example may be improved, and the overall size of the chip antenna module array 100*b* may be reduced.

FIGS. 2A to 2H are plan views illustrating chip antenna module arrays, according to examples.

Figure 2A:
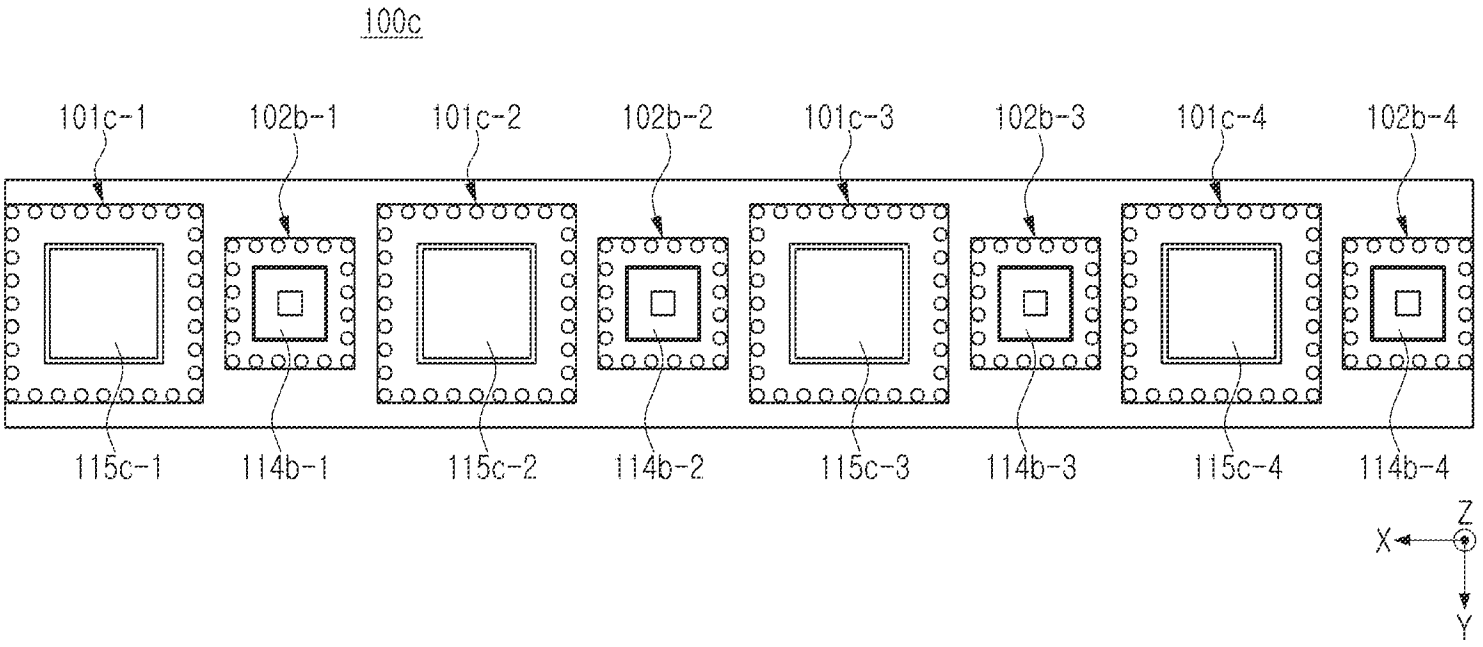
FIGS. 2A to 2H are plan views illustrating chip antenna module arrays, according to examples.
Figure 2B:
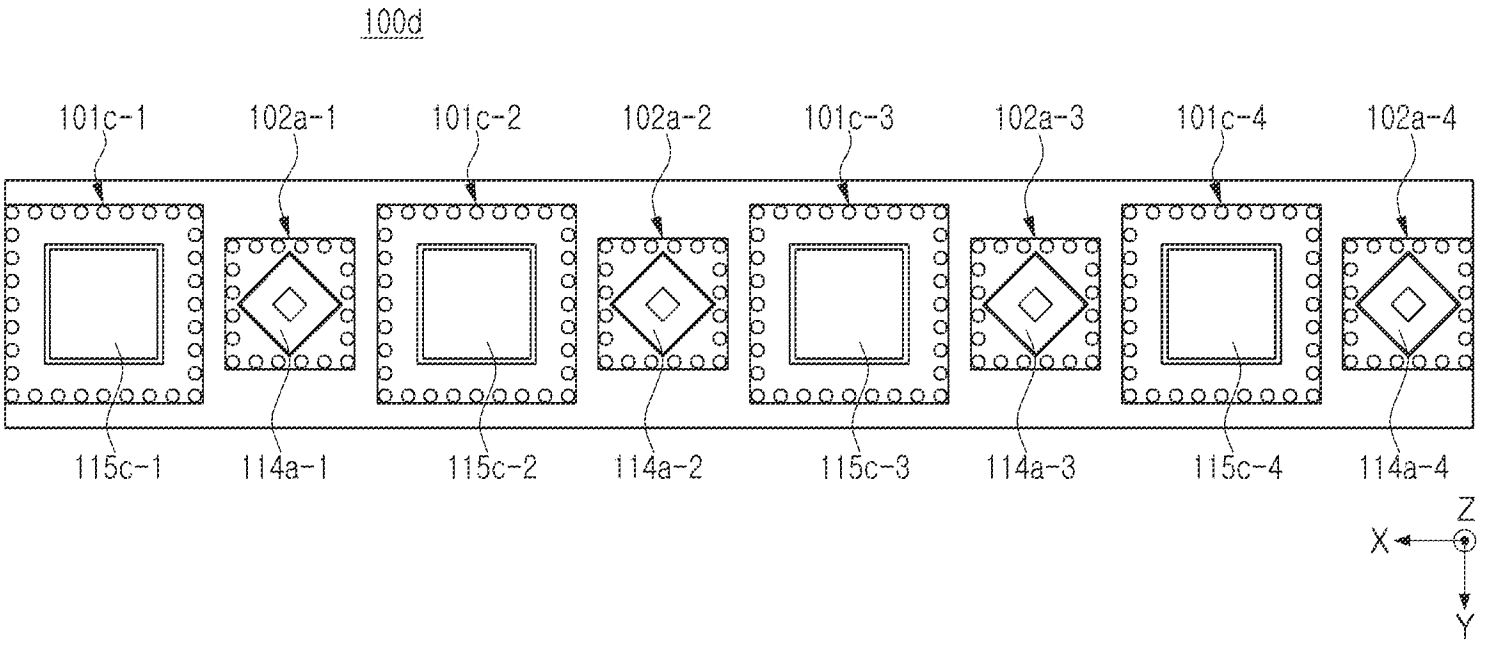
Figure 2C:
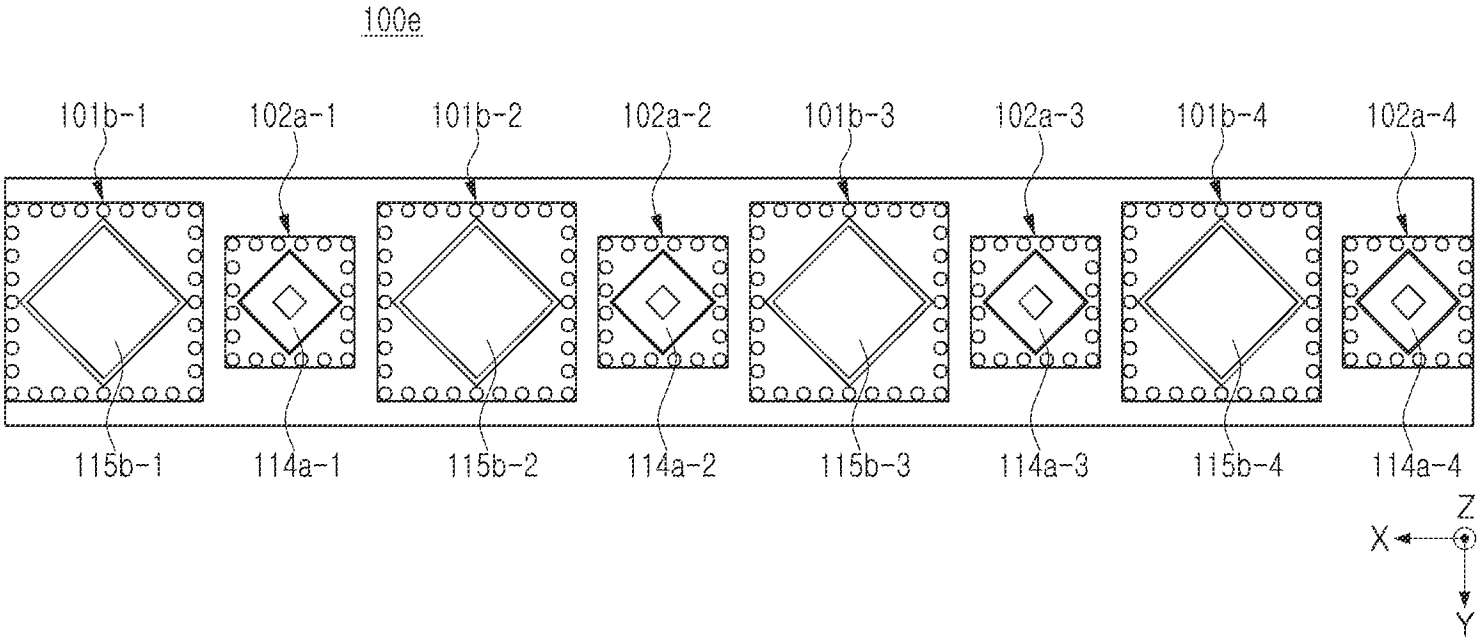
Figure 2D:
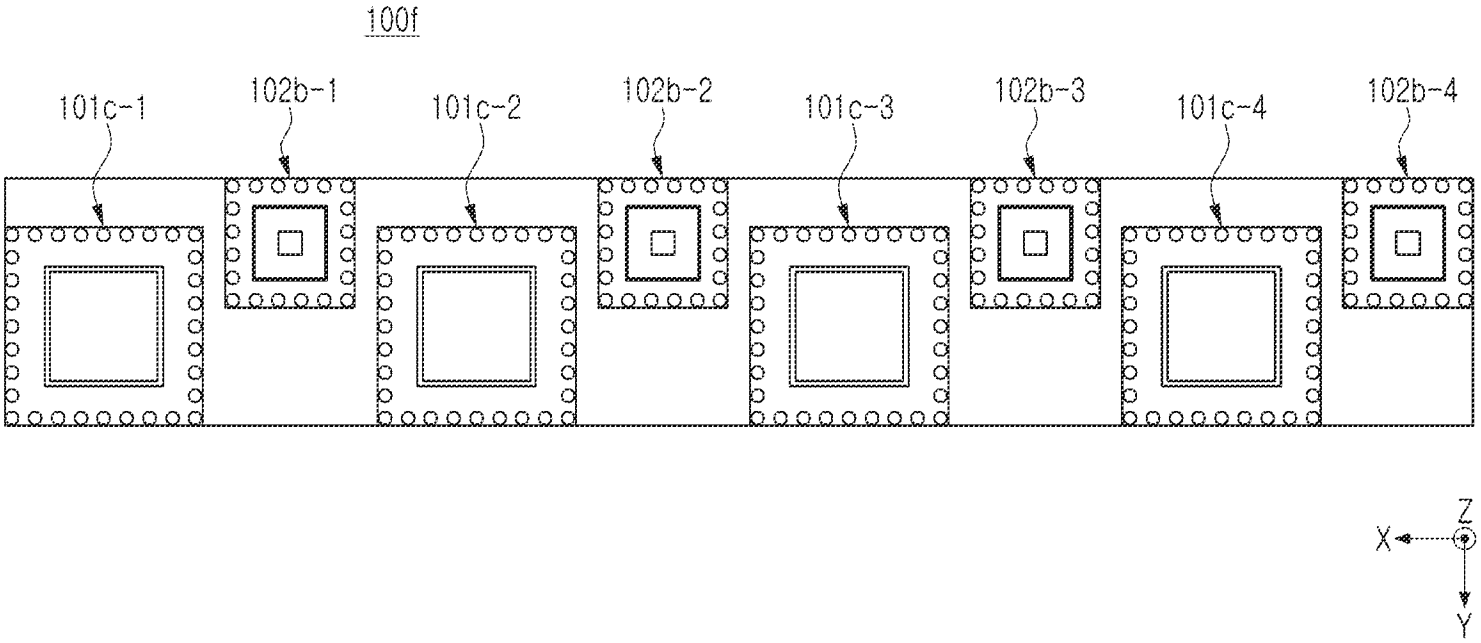

Referring to FIGS. 2A and 2D, chip antenna module arrays 100*c* and 100*f* may include third coupling patterns 115*c*-1, 115*c*-2, 115*c*-3, and 115*c*-4. A first patch antenna pattern of each the first chip antenna modules 101*c*-1, 101*c*-2, 101*c*-3, and 101*c*-4 may have a structure that is not rotated with respect to the respective first chip antenna module 101*c*-1, 101*c*-2, 101*c*-3, or 101*c*-4, and the second coupling patterns 114*b*-1, 114*b*-2, 114*b*-3, and 114*b*-4 and the respective second patch antenna patterns may have a structure that is not rotated with respect to the second chip antenna modules 102*b*-1, 102*b*-2, 102*b*-3, 102*b*-4.

Figure 2E:
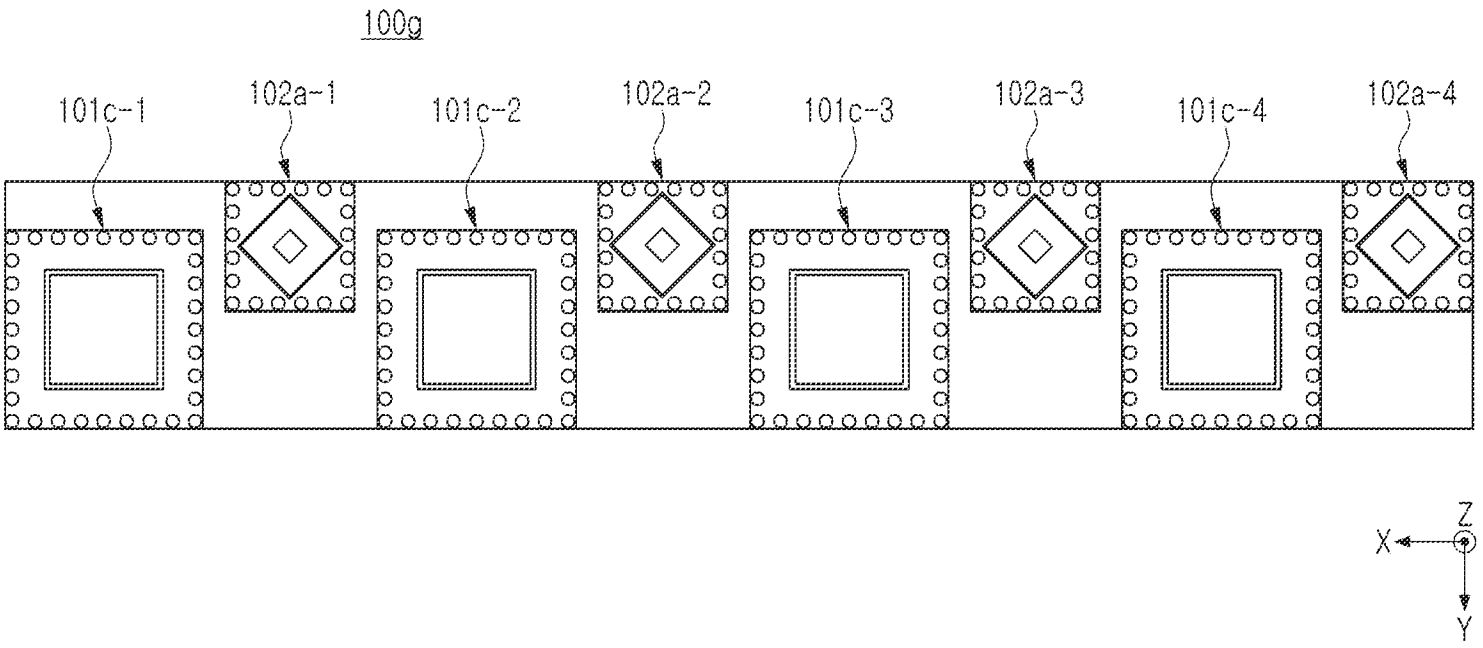

Referring to FIGS. 2B and 2E, chip antenna module arrays 100*d* and 100*g* may include the third coupling patterns 115*c*-1, 115*c*-2, 115*c*-3, and 115*c*-4. The first patch antenna patterns may have a structure that is not rotated with respect to the respective first chip antenna modules 101*c*-1, 101*c*-2, 101*c*-3, and 101*c*-4, and the second coupling patterns 114*a*-1, 114*a*-2, 114*a*-3, and 114*a*-4 and the second patch antenna patterns may be rotated about 45 degrees with respect to the respective second chip antenna modules 102*a*-1, 102*a*-2, 102*a*-3, and 102*a*-4.

Figure 2F:
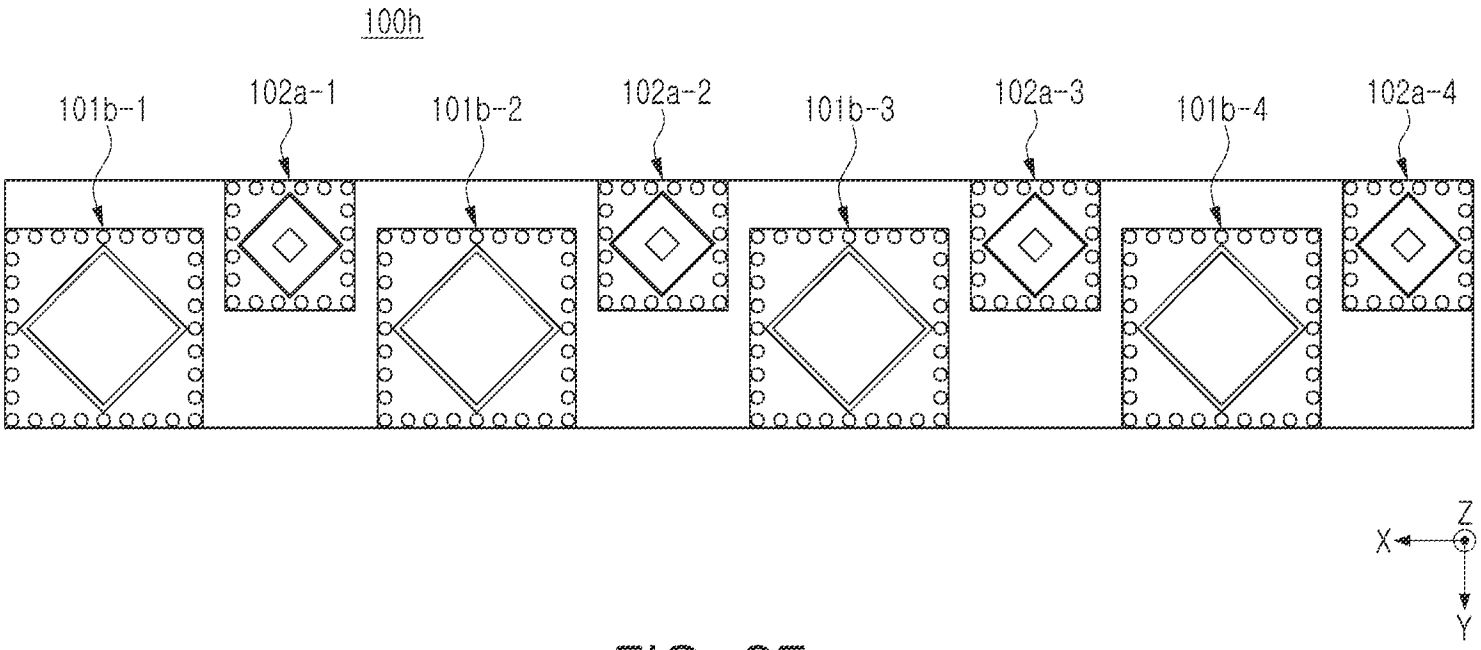

Referring to FIGS. 2C and 2F, chip antenna module arrays 100*e* and 100*h* may include the third coupling patterns 115*b*-1, 115*b*-2, 115*b*-3, and 115*b*-4. The first patch antenna patterns may have a structure that is rotated about 45 degrees with respect to the respective first chip antenna modules 101*b*-1, 101*b*-2, 101*b*-3, and 101*b*-4, and the second coupling patterns 114*a*-1, 114*a*-2, 114*a*-3, and 114*a*-4 and the second patch antenna patterns may be rotated about 45 degrees with respect to the respective second chip antenna modules 102*a*-1, 102*a*-2, 102*a*-3, and 102*a*-4.

Referring to FIGS. 2D, 2E, and 2F, the chip antenna module arrays 100*f*, 100*g*, and 100*h* may include at least a portion of a plurality of first chip antenna modules 101*b*-1, 101*b*-2, 101*b*-3, and 101*b*-4/101*c*-1, 101*c*-2, 101*c*-3, and 101*c*-4 and at least a portion of a plurality of second chip antenna modules 102*a*-1, 102*a*-2, 102*a*-3, and 102*a*-4 which are overlapped with each other in a first horizontal direction (for example, the X direction), and the plurality of second chip antenna modules 102*a*-1, 102*a*-2, 102*a*-3, and 102*a*-4/102*b*-1, 102*b*-2, 102*b*-3, and 102*b*-4 may be offset in a second horizontal direction (for example, Y direction) that is different from the first horizontal direction, with respect to the plurality of first chip antenna modules 101*b*-1, 101*b*-2, 101*b*-3, and 101*b*-4/101*c*-1, 101*c*-2, 101*c*-3, and 101*c*-4.

Accordingly, since the effects of the electric and magnetic fields of the plurality of first chip antenna modules 101*b*-1, 101*b*-2, 101*b*-3, and 101*b*-4/101*c*-1, 101*c*-2, 101*c*-3, and 101*c*-4 and the plurality of second chip antennas modules 102*a*-1, 102*a*-2, 102*a*-3, and 102*a*-4/102*b*-1, 102*b*-2, 102*b*-3 and 102*b*-4 on each other may be further reduced, chip antenna module arrays 100*f*, 100*g*, and 100*h* may have a further improved gain.

Figure 2G:
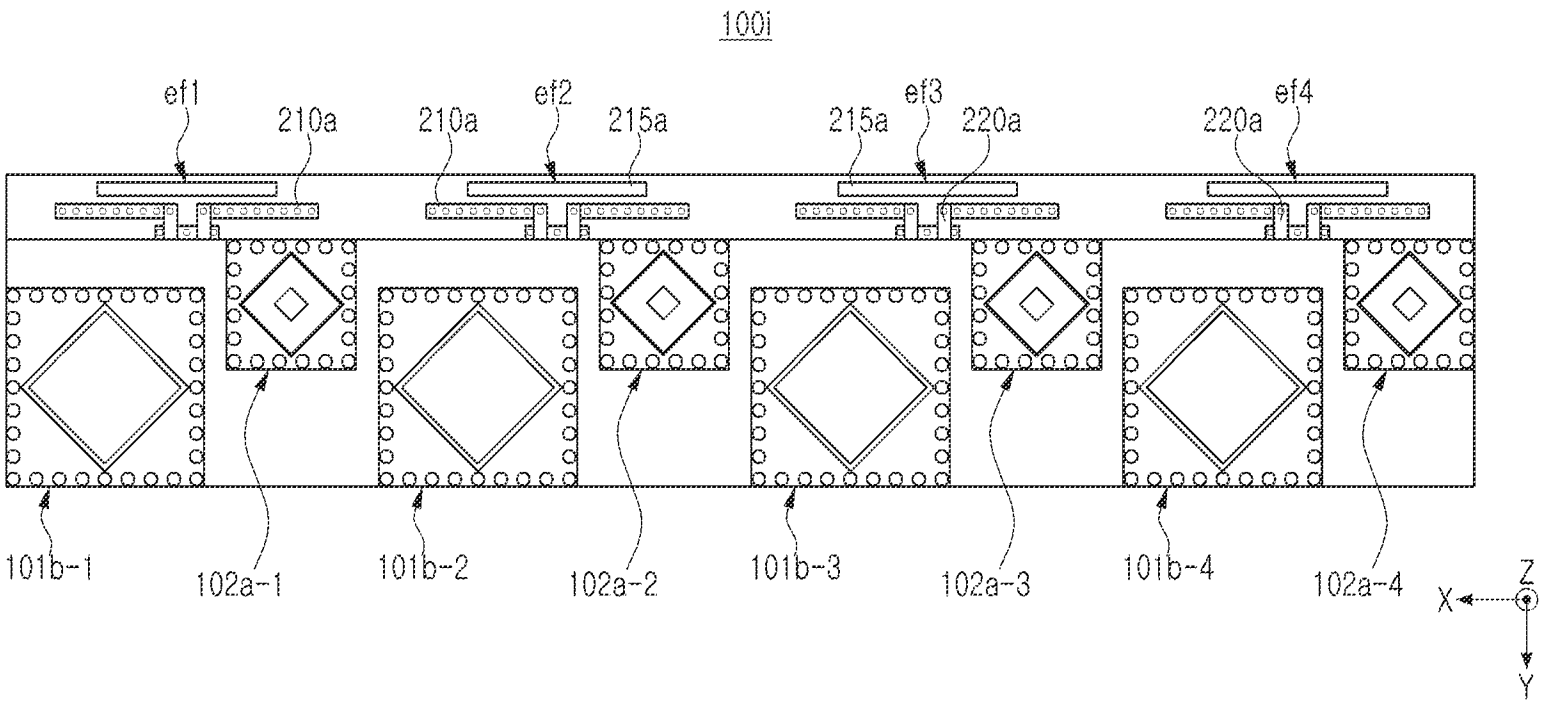

Referring to FIG. 2G, a chip antenna module array 100*i* may include a plurality of endfire antennas ef1, ef2, ef3, and ef4 arranged parallel to the plurality of first chip antenna modules 101*b*-1, 101*b*-2, 101*b*-3, 101*b*-4, and the plurality of second chip antenna modules 102*a*-1, 102*a*-2, 102*a*-3, and 102*a*-4. The plurality of endfire antennas ef1, ef2, ef3, and ef4 may form a radiation pattern of the RF signal in a horizontal direction (e.g., X and/or Y direction).

Each of the endfire antennas ef1, ef2, ef3, and ef4 may include a plurality of endfire antenna patterns 210*a* and a feed line 220*a*, and may further include a director pattern 215*a*.

Figure 2H:
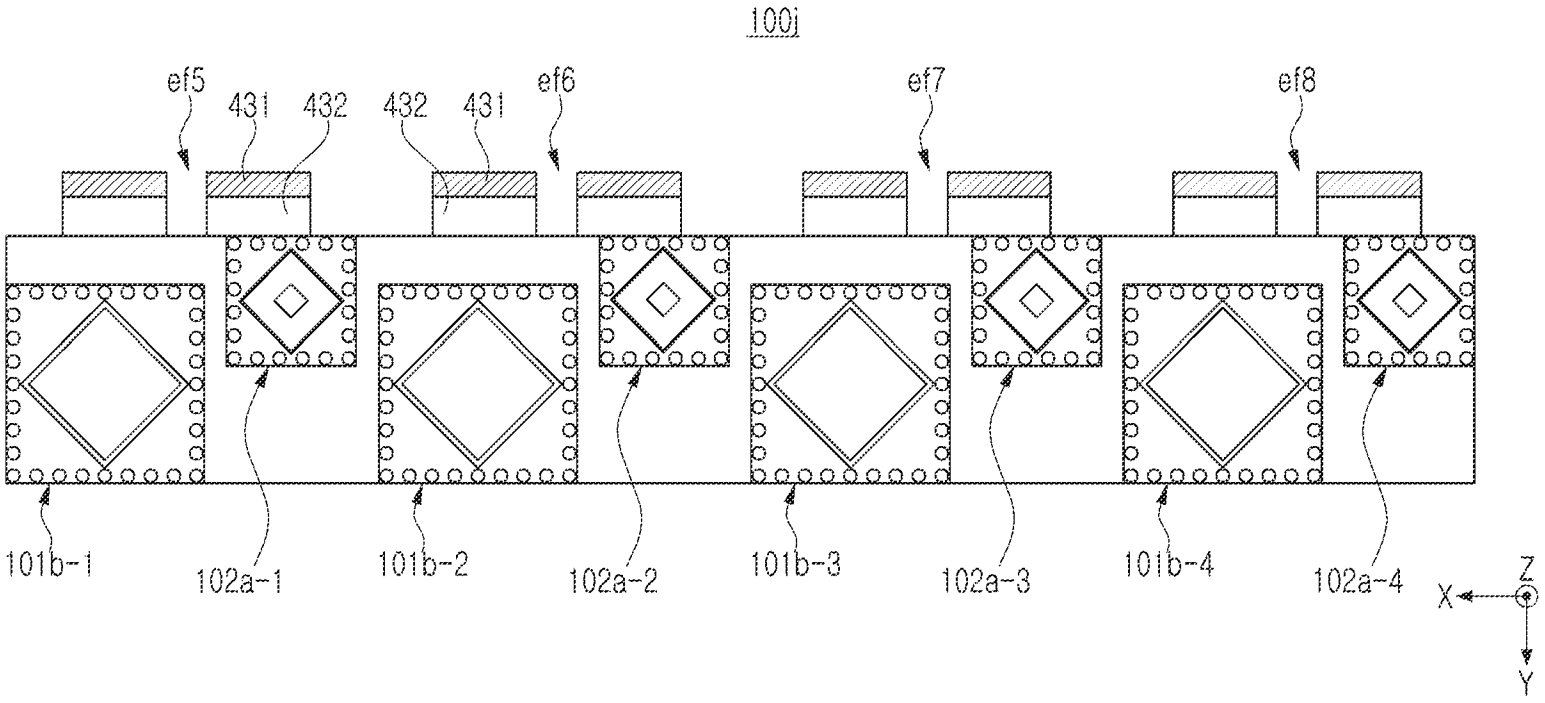

Referring to FIG. 2H, a chip antenna module array 100*j* may include a plurality of endfire antennas ef5, ef6, ef7, and ef8 arranged parallel to the plurality of first chip antenna modules 101*b*-1, 101*b*-2, 101*b*-3, and 101*b*-4 and the plurality of second chip antenna modules 102*a*-1, 102*a*-2, 102*a*-3, 102*a*-4, and may form a radiation pattern of the RF signal in the horizontal direction.

Each of the endfire antennas ef5, ef6, ef7, and ef8 may include a radiator body 431 and a dielectric body 432, respectively.

Figure 3A:
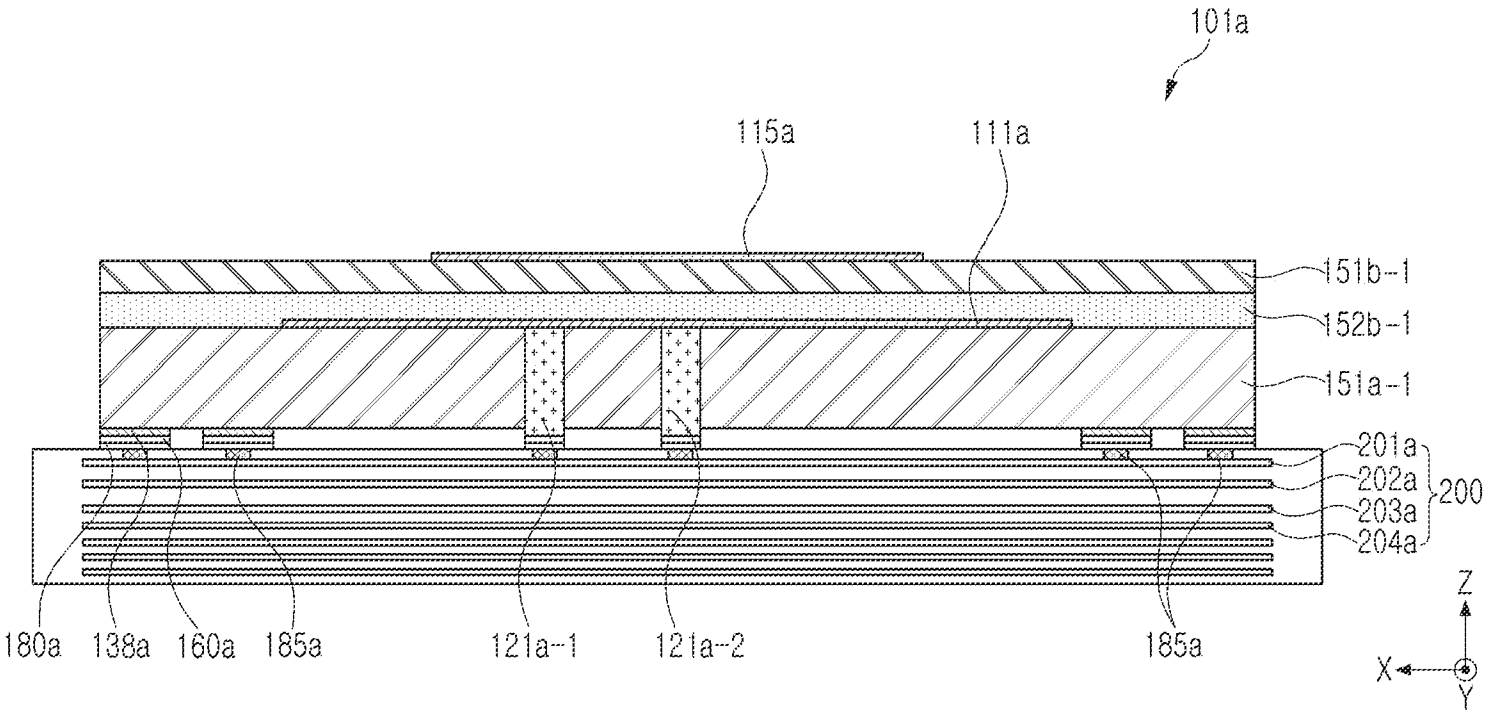
FIG. 3A is a side view illustrating a first chip antenna module included in a chip antenna module array, according to an example.
Figure 3B:
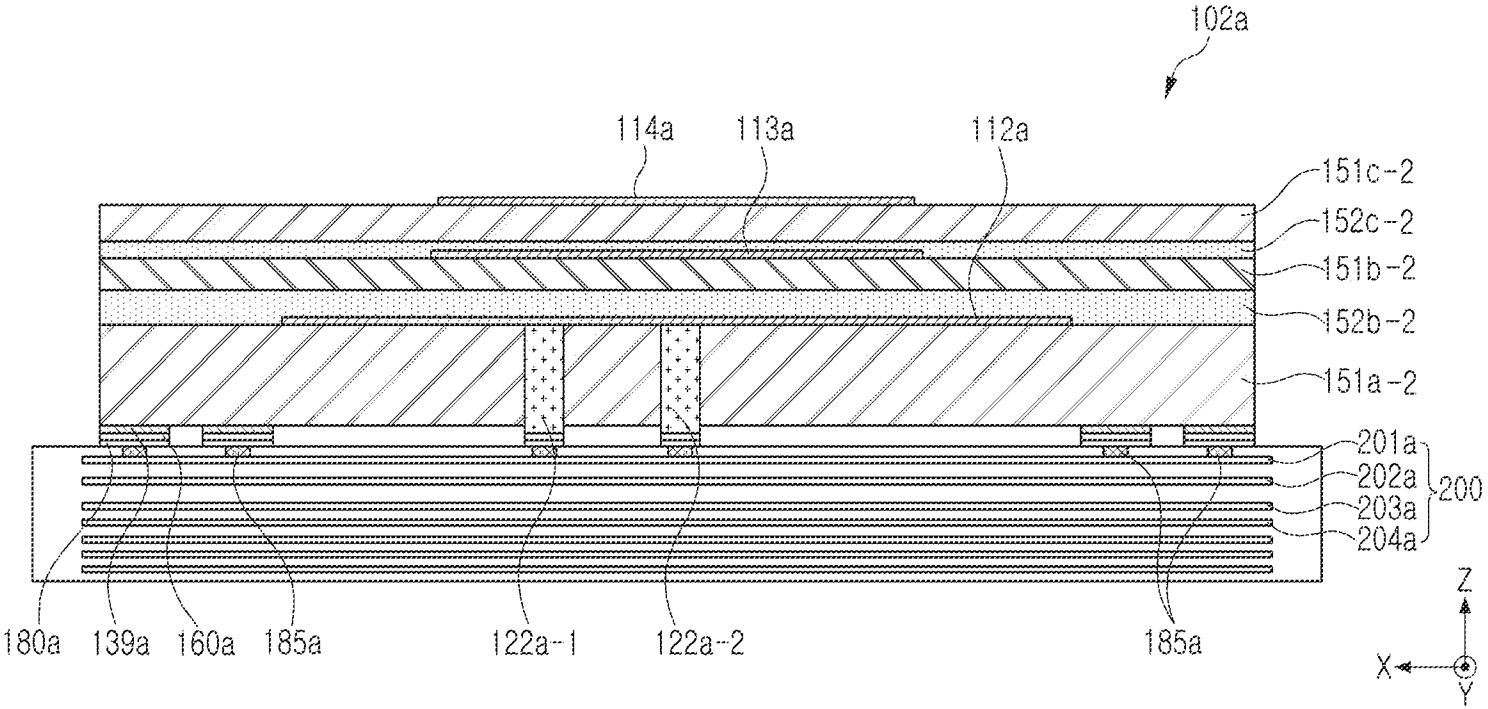
FIG. 3B is a side view illustrating a second chip antenna module included in a chip antenna module array, according to an example.
Figure 4A:
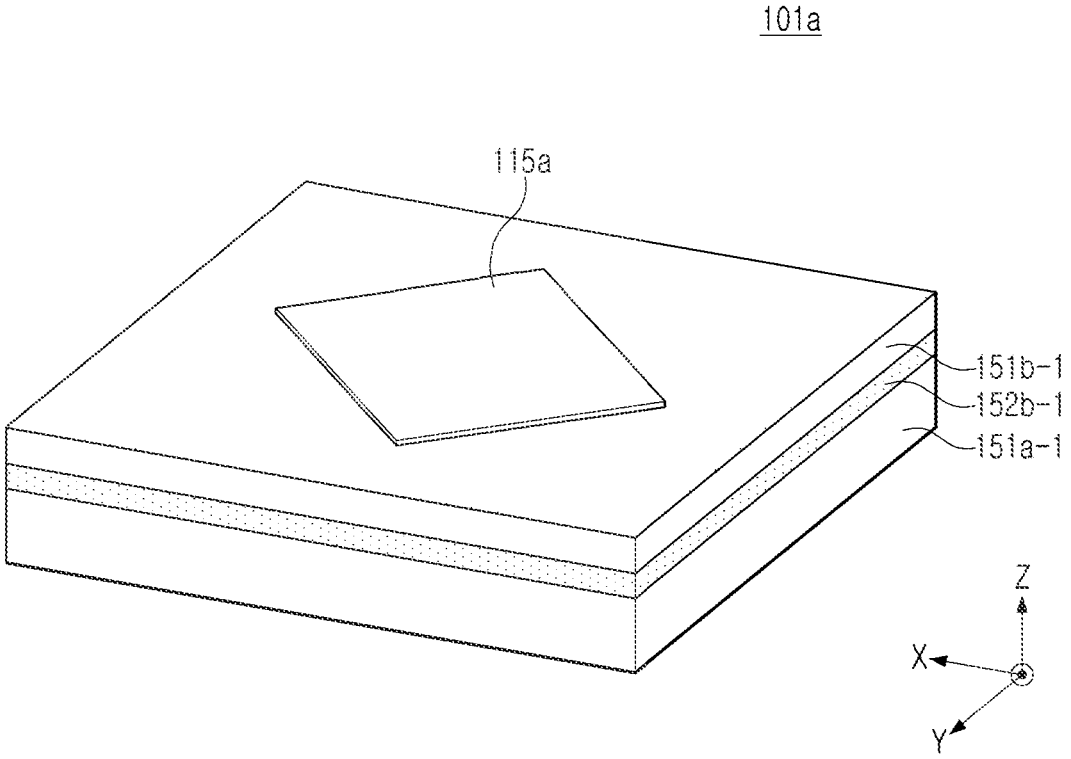
FIG. 4A is a perspective view illustrating an external appearance of a first chip antenna module included in a chip antenna module array, according to an example.
Figure 4B:
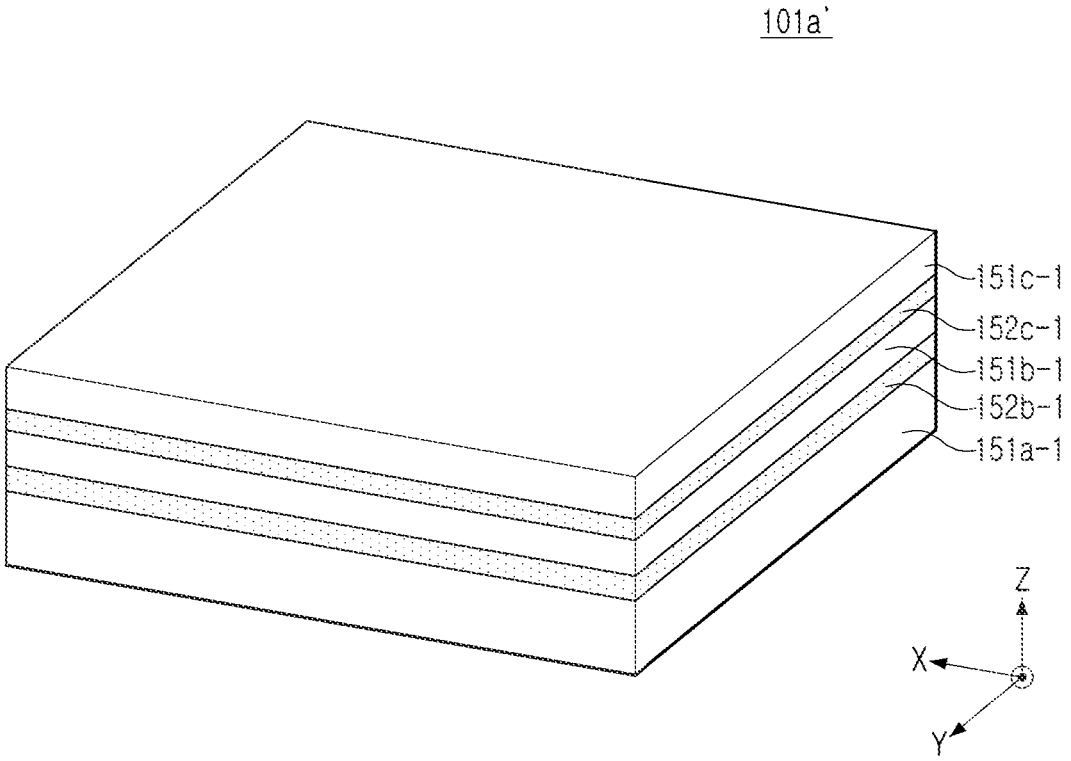
FIG. 4B is a perspective view illustrating a structure in which a 1-4-th dielectric layer and a 1-5-th dielectric layer are included in a first chip antenna module included in a chip antenna module array, according to an example.
Figure 4C:
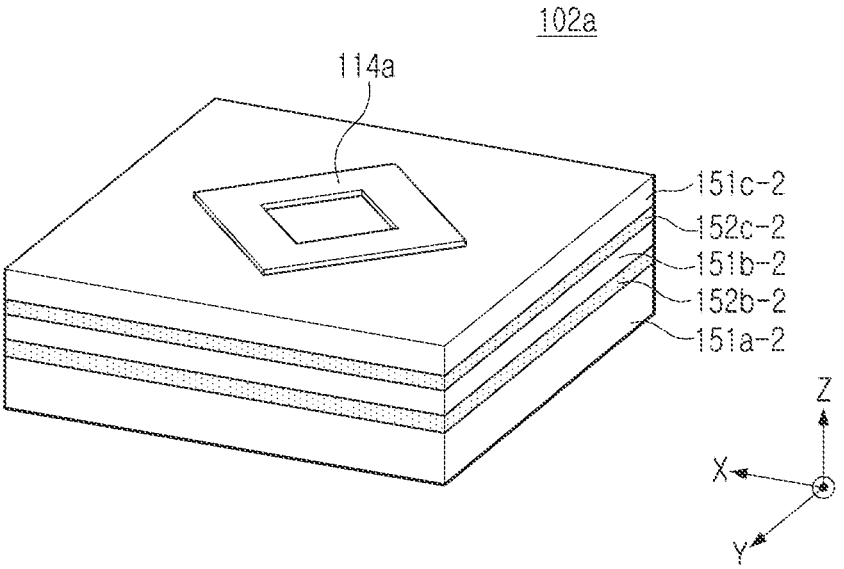
FIG. 4C is a perspective view illustrating an external appearance of a second chip antenna module included in a chip antenna module array, according to an example.

FIG. 3A is a side view illustrating the first chip antenna module included in a chip antenna module array 101*a*, according to an example. FIG. 3B is a side view illustrating the second chip antenna module 102*a* included in a chip antenna module array, according to an example. FIG. 4A is a perspective view illustrating an external appearance of the first chip antenna module 101*a* included in a chip antenna module array, according to an example. FIG. 4B is a perspective view illustrating a structure in which a 1-4-th dielectric layer and a 1-5-th dielectric layer are included a first chip antenna module 101*a*' included in a chip antenna module array, according to an example. FIG. 4C is a perspective view illustrating an external appearance of the second chip antenna module 102*a* included in a chip antenna module array according to an example.

Referring to FIGS. 3A and 4A, the first chip antenna module 101*a* may include at least one of a first dielectric layer 151*a*-1, a 1-2-th dielectric layer 152*b*-1, and a 1-3-th dielectric layer 151*b*-1. The first chip antenna module 101*a* may be mounted on the upper surface of a connecting member 200 through an electrical connection structure 160*a*.

Referring to FIGS. 3B and 4C, the second chip antenna module 102*a* may include at least one of a second dielectric layer 151*a*-2, a 2-2-th dielectric layer 152*b*-2, a 2-3-th dielectric layer 151*b*-2, and a 2-4-th dielectric layer 151*b*-2, and a 2-5-th dielectric layer 151*c*-2. The second chip antenna module 102*a* may be mounted on the top surface of the connection member 200 through the electrical connection structure 160*a*.

For example, the connection member 200 may have a structure in which the first ground plane 201*a* and second, third and fourth ground planes 202*a*, 203*a*, and 204*a* are sequentially stacked in an alternating order with a plurality of insulating layers. A connection-member solder layer 180*a* or the peripheral via 185*a* may be further included in the connection member 200.

Referring to FIGS. 3A and 4A, the 1-2-th dielectric layer 152*b*-1 may be disposed on an upper surface of the first dielectric layer 151*a*-1, and the 1-3-th dielectric layer 151*b*-1 may be disposed on the 1-2-th dielectric layer 152*b*-1.

Referring to FIG. 4B, the 1-4-th dielectric layer 152*c*-1 may be disposed on an upper surface of the 1-3-th dielectric layer 151*b*-1, and the 1-5-th dielectric layer 151*c*-1 may be disposed on an upper surface of the 1-4-th dielectric layer 152*c*-1.

Referring to FIGS. 3B and 4C, the 2-2-th dielectric layer 152*b*-2 may be disposed on an upper surface of the second dielectric layer 151*a*-2, and the 2-3-th dielectric layer 151*b*-2 may be disposed on an upper surface of the 2-2-th dielectric layer 152*b*-2. The 2-4-th dielectric layer 152*c*-2 may be disposed on the upper surface of the 2-4-th dielectric layer 151*b*-2. The 2-5-th dielectric layer 151*c*-2 may be disposed on an upper surface of the 2-4-th dielectric layer 152*c*-2.

For example, the 1-3-th, 1-5-th, 2-3-th, and 2-5-th dielectric layers 151*b*-1, 151*c*-1, 151*b*-2, and 151*c*-2 may include the same material as a material of the first and second dielectric layers 151*a*-1 and 151*a*-2, and the 1-2-th and 1-4-th dielectric layers 152*b*-1 and 152*c*-1 may include the same material as a material of the 2-2-th and 2-4-th dielectric layers 152*b*-2 and 152*c*-2.

For example, the 1-2-th, 1-4-th, 2-2-th, and 2-4-th dielectric layers 152*b*-1, 152*c*-1, 152*b*-2, and 152*c*-2 may include materials different from those of the first, 1-3-th, 1-5-th, second, 2-3-th and 2-5-th dielectric layers 151*a*-1, 151*b*-1, 151*c*-1, 151*a*-2, 151*b*-2 and 151*c*-2. For example, the 1-2-th, 1-4-th, 2-2-th, and 2-4-th dielectric layers 152*b*-1, 152*c*-1, 152*b*-2, and 152*c*-2 may include a polymer having adhesive properties for increasing bonding force between the first, 1-3-th, 1-5-th, second, 2-3-th and 2-5-th dielectric layers 151*a*-1, 151*b*-1, 151*c*-1, 151*a*-2, 151*b*-2, and 151*c*-2. For example, the 1-2-th, 1-4-th, 2-2-th, and 2-4-th dielectric layers 152*b*-1, 152*c*-1, 152*b*-2, and 152*c*-2 may include ceramic materials having a dielectric constant lower than that of the first, 1-3-th, 1-5-th, second, 2-3-th and 2-5-th dielectric layers 151*a*-1, 151*b*-1, 151*c*-1, 151*a*-2, 151*b*-2, and 151*c*-2 to form dielectric medium interfaces between the first, 1-3-th, 1-5-th, second, 2-3-th and 2-5-th dielectric layers 151*a*-1, 151*b*-1, 151*c*-1, 151*a*-2, 151*b*-2, and 151*c*-2, may include a material having relatively high flexibility such as liquid crystal polymer (LCP) or polyimide, or may include materials such as an epoxy resin or Teflon to have relatively strong durability and relatively high adhesion.

The dielectric medium interface may refract the propagation direction of the RF signal to further concentrate the direction of forming the radiation pattern of the chip antenna module 100*b* in the vertical direction (for example, Z direction).

Referring to FIG. 3A, the upper surface of the 1-3-th dielectric layer 151*b*-1 may be an arrangement space of a third coupling pattern 115*a*.

Referring to FIG. 3B, the upper surface of the 2-4th dielectric layer 151*b*-2 may be an arrangement space of the second coupling pattern 113*a*, and an upper surface of the 2-5-th dielectric layer 151*c*-2 may be an arrangement space of the second coupling pattern 114*a*.

Referring to FIG. 4B, according to design parameters, the first chip antenna module 101*a* may further include either one or both of the 1-4-th dielectric layer 152*c*-1 and the 1-5-th dielectric layer 151*c*-1. The 1-4-th dielectric layer 152*c*-1 may be disposed on an upper surface of the 1-3-th dielectric layer 151*b*-1, and the 1-5-th dielectric layer 151*c*-1 may be disposed on an upper surface of the 1-4-th dielectric layer 152*c*-1.

Meanwhile, the dielectric constants of the first and second dielectric layers 151*a*-1 and 151*a*-2 may be different from each other.

For example, when the first frequency band of the first chip antenna module 101*a* is lower than the second frequency band of the second chip antenna module 102*a*, and the dielectric constant of the first dielectric layer 151*a*-1 is higher than the dielectric constant of the second dielectric layer 151*a*-2, the difference between the size of the first chip antenna module 101*a* and the size of the second chip antenna module 102*a* may be small.

Accordingly, since the arrangement regularity of a structure in which the plurality of first chip antenna modules 101*a* and the plurality of second chip antenna modules 102*a* are arranged in an alternating order may be further improved, the plurality of first chip antenna modules 101*a* and the plurality of first chip antenna modules 101*a* may be improved. The plurality of second chip antenna modules 102*a* may be arranged more compactly in general while ensuring antenna performance for the first and second frequency bands.

Figure 5A:
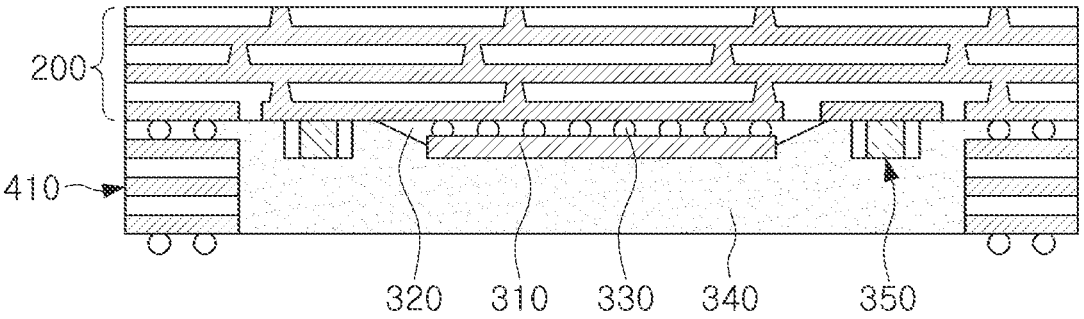
FIGS. 5A to 5B are side views illustrating a lower structure of a connecting member illustrated in FIGS. 3A and 3B, according to an example.
Figure 5B:
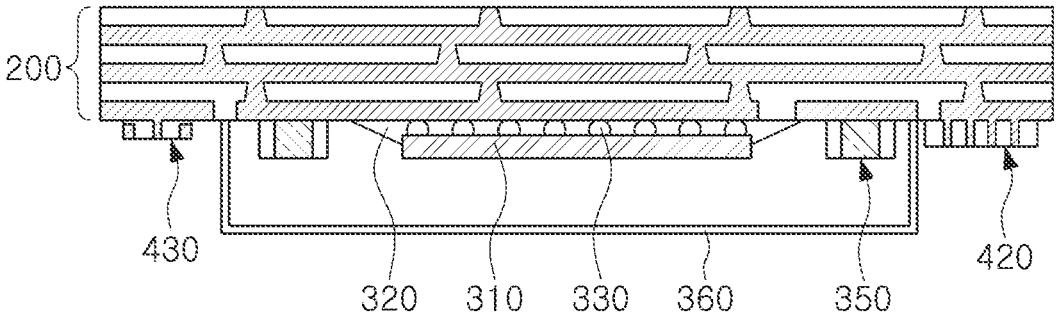

FIGS. 5A to 5B are side views illustrating a lower structure of the connecting member 200 illustrated in FIGS. 3A and 3B.

Referring to FIG. 5A, the connection member 200 may include arrangement spaces of at least one of an IC 310, an adhesive member 320, an electrical connection structure 330, an encapsulant 340, a passive component 350, and a core member 410.

The IC 310 may be disposed under the connection member 200, and frequency conversion, amplification, filtering, and may perform phase control on the RF signal remotely transmitted and/or received by a chip antenna module according to an embodiment disclosed herein. The IC 310 may be electrically connected to wiring of the connection member 200 to transmit or receive an RF signal, and may be electrically connected to the ground plane 201*a* of the connection member 200 to receive ground.

The adhesive member 320 may bond the IC 310 and the connection member 200 to each other.

The electrical connection structure 330 may electrically connect the IC 310 and the connection member 200. For example, the electrical connection structure 330 may have a structure such as solder balls, pins, lands, or pads. The electrical connection structure 330 may have a lower melting point than the wiring and the ground plane 201*a* of the connection member 200, and may be electrically connected the IC 310 and the connection member 200 through a predetermined process using the low melting point.

The encapsulant 340 may seal at least a portion of the IC 310, and may improve heat dissipation performance and impact protection performance of the IC 310. For example, the encapsulant 340 may be implemented by a photo imageable encapsulant (PIE), an Ajinomoto build-up film (ABF), an epoxy molding compound (EMC), or the like.

The passive component 350 may be disposed on the lower surface of the connection member 200, and may be electrically connected to the wiring and/or the ground plane 201*a* of the connection member 200 through the electrical connection structure 330. For example, the passive component 350 may include any one or any combination of any two or more of a capacitor (for example, a multi-layer ceramic capacitor (MLCC)), an inductor, and a chip resistor.

The core member 410 may be disposed under the connection member 200, and may receive an intermediate frequency (IF) signal or a base band signal from the outside environment and transmit the received IF signal to the IC 310 or from the IC 310. The core member 410 may be electrically connected to the connection member 200 to receive the IF signal or the baseband signal to transmit to the outside environment. In such an example, the frequency (for example, 24 GHz, 28 GHz, 36 GHz, 39 GHz, 60 GHz) of the RF signal is greater than the frequency of the IF signal (for example, 2 GHz, 5 GHz, 10 GHz, etc.).

For example, the core member 410 may transmit or receive an IF signal or a baseband signal to or from the IC 310 through a wire that may be included in the IC ground plane of the connection member 200.

Referring to FIG. 5B, the connection member 200 in which a chip antenna module according to an embodiment disclosed herein is mounted may include at least some of a shield member 360, a connector 420, and an end-fire chip antenna 430.

The shielding member 360 may be disposed under the connection member 200 to confine the IC 310 together with the connection member 200. For example, the shielding member 360 may be arranged to cover (for example, conformally shield) the IC 310 and the passive component 350 together or to separately cover (for example, compartmentally shield) the IC 310 and the passive component 350. For example, the shielding member 360 may have a shape of a hexahedron having one surface open, and may have a hexahedral receiving space through coupling with the connection member 200. The shielding member 360 may be made of a material having high conductivity such as copper to have a short skin depth, and may be electrically connected to the ground plane 201*a* of the connecting member 200. Accordingly, the shielding member 360 may reduce electromagnetic noise that may be received by the IC 310 and the passive component 350.

The connector 420 may have a connection structure of a cable (for example, a coaxial cable, a flexible PCB), may be electrically connected to the IC ground plane of the connection member 200, and may have a function similar to that of the core member 410 described above. For example, the connector 420 may receive an IF signal, a baseband signal and/or a power from a cable, or provide an IF signal and/or a baseband signal to a cable.

The end-fire chip antenna 430 may transmit or receive an RF signal in support of a chip antenna module, according to an example. For example, the end-fire chip antenna 430 may include a dielectric block having a dielectric constant greater than that of the insulating layer, and a plurality of electrodes disposed on both sides of the dielectric block. One of the plurality of electrodes may be electrically connected to the wiring of the connection member 200, and the other may be electrically connected to the ground plane 201*a* of the connection member 200.

Figure 6A:
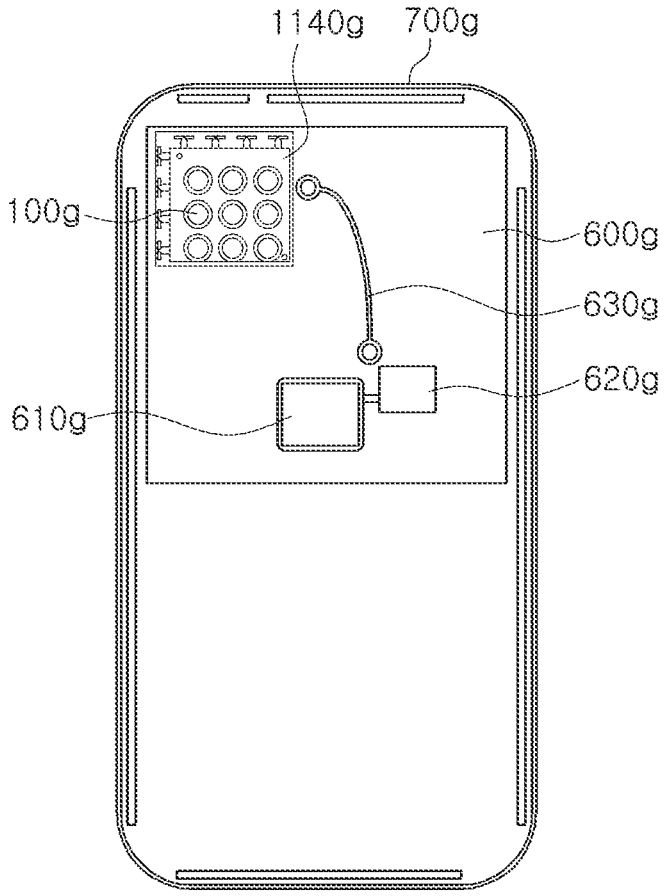
FIGS. 6A and 6B are plan views illustrating electronic devices including a chip antenna module, according to examples.
Figure 6B:
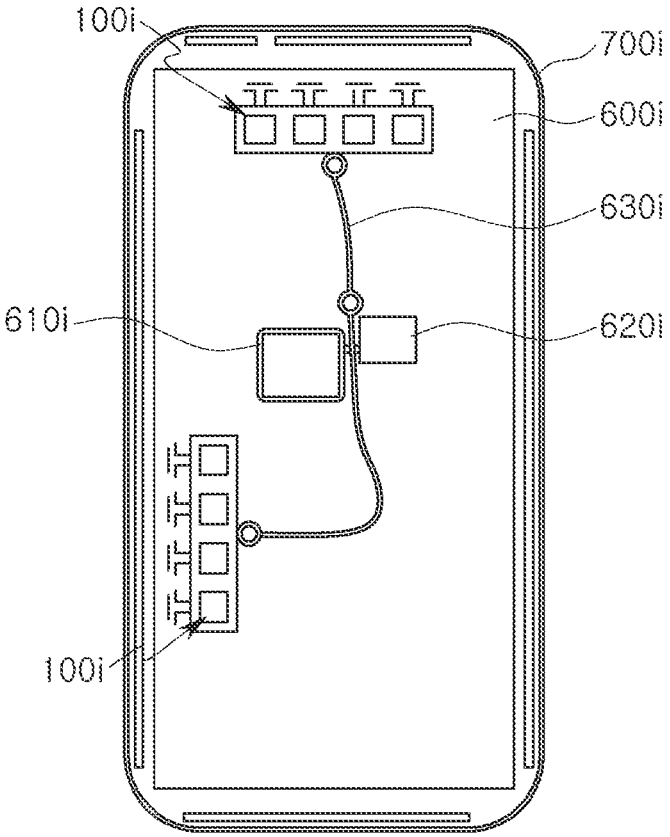

FIGS. 6A and 6B are plan views illustrating electronic devices including a chip antenna module, according to an example.

Referring to FIG. 6A, a connection member on which the chip antenna module 100*g* is mounted, according to an example, is disposed adjacent to a side boundary of an electronic device 700*g* on the set substrate 600*g* of the electronic device 700*g*.

The electronic device 700*g* may be, for example, a smartphone, a personal digital assistant, a digital video camera, a digital still camera, a network system, a personal computer, a monitor, a tablet, a laptop, a netbook, a television, a video game device, a smartwatch, an automotive component, or the like, but is not limited to the foregoing examples.

A communication module 610*g* and a baseband circuit 620*g* may also be disposed on the set substrate 600*g*. The chip antenna module may be electrically connected to the communication module 610*g* and/or the baseband circuit 620*g* through a coaxial cable 630*g*.

The communication module 610*g* may include: a memory chip such as volatile memory (for example, DRAM), nonvolatile memory (for example, ROM), or flash memory to perform digital signal processing; application processor chips such as central processors (for example, CPUs), graphics processors (for example, GPUs), digital signal processors, cryptographic processors, microprocessors, and/or microcontrollers; and at least a portion of a logic chip, such as an analog-to-digital converter, or an application-specific IC (ASIC).

The baseband circuit 620*g* may generate a base signal by performing analog-to-digital conversion, amplification, filtering, and frequency conversion on an analog signal. The base signal input and output from the baseband circuit 620*g* may be transmitted to the chip antenna module through a cable.

For example, the base signal may be transmitted to the IC through an electrical connection structure, core vias, and wiring. The IC may convert the base signal into an RF signal of a millimeter wave (mmWave) band.

Referring to FIG. 6B, a plurality of connection members on which chip antenna modules 100*i* are respectively mounted may be disposed on multiple sides of a polygonal electronic device 700*i* on a set substrate 600*i* of the electronic device 700*i*. A communication module 610*i* and a baseband circuit 620*i* may be disposed on the set substrate 600*i*. The chip antenna modules 100*i* may be electrically connected to the communication module 610*i* and/or the baseband circuit 620*i* through a coaxial cable 630*i*.

Referring to FIG. 6A, the dielectric layer 1140*g* may be filled in at least a portion of a space between a plurality of chip antenna modules according to an example.

The dielectric and insulating layers disclosed herein may be formed of an FR4, a liquid crystal polymer (LCP), a low temperature co-fired ceramic (LTCC), a thermosetting resin such as an epoxy resin, a thermoplastic resin such as a polyimide resin, a resin in which the thermosetting resin or the thermoplastic resin is mixed with an inorganic filler or is impregnated together with an inorganic filler in a core material such as a glass fiber (or a glass cloth or a glass fabric), for example, prepreg, Ajinomoto build-up film (ABF), FR-4, Bisaleimide Triazine (BT), or the like, a photoimageable dielectric (PID) resin, a copper clad laminate (CCL), a glass or ceramic-based insulating material, or the like.

The patterns, the vias, the planes, the strips, the lines, and the electrical connection structures disclosed herein may include a metal material (for example, copper (Cu), aluminum (Al), silver (Ag), tin (Sn), gold (Au), nickel (Ni), lead (Pb), titanium (Ti), alloys thereof, or the like), and may be formed using a plating method such as chemical vapor deposition (CVD), physical vapor deposition (PVD), sputtering, a subtractive process, an additive process, a semi-additive process (SAP), a modified semi-additive process (MSAP), or the like, but are not limited to the foregoing materials and formation methods.

RF signals disclosed herein may be Wi-Fi (IEEE 802.11 family, etc.), WiMAX (IEEE 802.16 family, etc.), IEEE 802.20, LTE (long term evolution), Ev-DO, HSPA+, HSDPA+, HSUPA+, or EDGE signals. The RF signals may have a format in accordance with, but not limited to, GSM, GPS, GPRS, CDMA, TDMA, DECT, Bluetooth, 3G, 4G, 5G and any other wireless and wired protocols designated.

As set forth above, a chip antenna module array according to embodiments disclosed herein may provide a transmission and reception means for a plurality of different frequency bands to improve the antenna performance (for example, gain, bandwidth, directivity, transmission and reception rate, and the like), and/or may be easily miniaturized.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna module array, comprising:

a first chip antenna module comprising:

a first dielectric layer;

a first feed via forming a first feed path through the first dielectric layer;

a first patch antenna pattern disposed on the first dielectric layer in a vertical direction, electrically connected to the first feed via, and having a first resonant frequency; and a first coupling pattern electrically coupled to the first patch antenna pattern;

a second chip antenna module comprising:

a second dielectric layer;

a second feed via forming a second feed path through the second dielectric layer;

a second patch antenna pattern disposed on the second dielectric layer in the vertical direction, electrically connected to the second feed via, and having a second resonant frequency different from the first resonant frequency; and a second coupling pattern electrically coupled to the second patch antenna pattern; and a connection member electrically connected to the first chip antenna module and the second chip antenna module, respectively, and having a top surface on which the first chip antenna module and the second chip antenna module are spaced apart from each other.

2. The chip antenna module array of claim 1, wherein the second coupling pattern overlaps the second patch antenna pattern in the vertical direction and comprises a slot.

3. The chip antenna module array of claim 2, wherein the first coupling pattern is spaced from the first patch antenna pattern in a horizontal direction and has a polygonal shape that does not include a slot.

4. The chip antenna module array of claim 2, wherein the first chip antenna module further comprises a third coupling pattern disposed at a level in the vertical direction higher than the first patch antenna pattern, spaced apart from the first patch antenna pattern, and overlapping the first patch antenna pattern in the vertical direction, and wherein the third coupling pattern has a polygonal shape and does not include a slot.

5. The chip antenna module array of claim 4, wherein the second chip antenna module further comprises a fourth coupling pattern spaced apart from the second patch antenna pattern, overlapping the second patch antenna pattern in the vertical direction, and disposed between the second patch antenna pattern and the second coupling pattern in the vertical direction, and wherein the fourth coupling pattern has a polygonal shape and does not include a slot.

6. The chip antenna module array of claim 1, wherein the second chip antenna module further comprises a space filled with an insulating material or air, and wherein the space does not overlap the second patch antenna pattern in the vertical direction, and overlaps the second dielectric layer in the vertical direction.

7. The chip antenna module array of claim 1, wherein a total size of an upper surface of the second dielectric layer is smaller than a total size of an upper surface of the first dielectric layer.

8. The chip antenna module array of claim 1, wherein the first chip antenna module further comprises:

a first feed pattern extending from an upper end of the first feed via and overlapping at least a first portion of the first coupling pattern in the vertical direction, and disposed below the first coupling pattern; and a second feed pattern extending from a lower end of the first feed via and overlapping at least a second portion of the first coupling pattern in the vertical direction, and disposed below the first coupling pattern.

9. The chip antenna module array of claim 1, wherein the first coupling pattern surrounds at least a portion of an edge of the first patch antenna pattern.

10. The chip antenna module array of claim 9, wherein the first coupling pattern and the first patch antenna pattern are disposed at a same level in the vertical direction.

11. The chip antenna module array of claim 1, wherein an upper surface of the first dielectric layer has a polygonal shape, wherein the first patch antenna pattern has a polygonal shape, and at least some sides of the first patch antenna pattern are oblique with respect to each of plural sides of the upper surface of the first dielectric layer.

12. The chip antenna module array of claim 11, wherein an upper surface of the second dielectric layer has a polygonal shape, and wherein the second patch antenna pattern has a polygonal shape, and at least some sides of the second patch antenna pattern are oblique with respect to each of plural sides of the upper surface of the second dielectric layer.

13. The chip antenna module array of claim 12, further comprising:

a plurality of first chip antenna modules including the first chip antenna module; and a plurality of second chip antenna modules including the second chip antenna module, wherein at least a portion of the plurality of first chip antenna modules and at least a portion of the plurality of second chip antenna modules overlap in a first horizontal direction, and the plurality of second chip antenna modules are offset from the plurality of first chip antenna modules in a second horizontal direction different from the first horizontal direction.

14. The chip antenna module array of claim 1, wherein a dielectric constant of the first dielectric layer and a dielectric constant of the second dielectric layer are different from each other.

15. The chip antenna module array of claim 1, wherein the second feed via is in contact with the second patch antenna pattern, and wherein the first feed via is not in contact with the first patch antenna pattern.

* * * * *